US010520870B2

(12) United States Patent
Takagi et al.

(10) Patent No.: US 10,520,870 B2
(45) Date of Patent: Dec. 31, 2019

(54) IMAGE FORMING APPARATUS WITH REDUCED LONG PERIOD GAP VARIATION

(71) Applicants: Hiroaki Takagi, Kanagawa (JP); Kimiharu Yamazaki, Kanagawa (JP); Naoyuki Suido, Kanagawa (JP)

(72) Inventors: Hiroaki Takagi, Kanagawa (JP); Kimiharu Yamazaki, Kanagawa (JP); Naoyuki Suido, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/616,822

(22) Filed: Jun. 7, 2017

(65) Prior Publication Data

US 2017/0357200 A1 Dec. 14, 2017

(30) Foreign Application Priority Data

Jun. 8, 2016 (JP) ..... 2016-114374

(51) Int. Cl.
*G03G 15/00* (2006.01)
*G03G 15/02* (2006.01)
*G03G 15/06* (2006.01)

(52) U.S. Cl.
CPC ..... *G03G 15/5008* (2013.01); *G03G 15/0275* (2013.01); *G03G 15/065* (2013.01)

(58) Field of Classification Search
CPC ..... G03G 15/065; G03G 15/0275; G03G 15/5008
See application file for complete search history.

(56) References Cited

U.S. PATENT DOCUMENTS 5,848,333 A * 12/1998 An ..... G03G 15/5008 399/167
2003/0138271 A1* 7/2003 Cho ..... G03G 15/101 399/237
2006/0029435 A1* 2/2006 Kasai ..... G03G 15/0898 399/267
2008/0107449 A1* 5/2008 Oohara ..... G03G 15/5008 399/167

(Continued)

FOREIGN PATENT DOCUMENTS

JP 2015-007747 1/2015
JP 2015-090475 5/2015

*Primary Examiner* — David M. Gray
*Assistant Examiner* — Andrew V Do
(74) *Attorney, Agent, or Firm* — Duft & Bornsen, PC

(57) ABSTRACT

An image forming apparatus includes a drive device including a first drive transmission passage through which a driving force of a drive source is transmitted to a developer bearer via a first joint and a second drive transmission passage through which the driving force is transmitted to a rotary body via a second joint. The first drive transmission passage and the second drive transmission passage are defined such that one of a first drive transmission ratio to the first joint of the first drive transmission passage and a second drive transmission ratio to the second joint of the second drive transmission passage is an integral multiple of the other of the first drive transmission ratio from the drive source to the first joint of the first drive transmission passage and the second drive transmission ratio from the drive source to the second joint of the second drive transmission passage.

11 Claims, 17 Drawing Sheets

(56) References Cited

U.S. PATENT DOCUMENTS

| | | | | |
|---|---|---|---|---|
| 2012/0251176 | A1* | 10/2012 | Young | G03G 15/0194 399/167 |
| 2015/0355569 | A1* | 12/2015 | Hisa | G03G 15/50 399/53 |
| 2016/0062300 | A1 | 3/2016 | Takagi et al. | |
| 2017/0010576 | A1 | 1/2017 | Takagi et al. | |
| 2017/0045856 | A1* | 2/2017 | Kawai | G03G 15/757 |

* cited by examiner

A: IMAGE DENSITY NONUNIFORMITY
B: PRIMARY COMPONENT FITTING OF DEVELOPING SLEEVE

A: IMAGE DENSITY NONUNIFORMITY
B. IMAGE DENSITY NONUNIFORMITY − PRIMARY COMPONENT FITTING OF DEVELOPING SLEEVE

A: IMAGE DENSITY NONUNIFORMITY
B: PRIMARY COMPONENT FITTING OF DEVELOPING SLEEVE
C: SECONDARY COMPONENT FITTING OF DEVELOPING SLEEVE

A: IMAGE DENSITY NONUNIFORMITY
B. IMAGE DENSITY NONUNIFORMITY − PRIMARY COMPONENT FITTING OF DEVELOPING SLEEVE

IMAGE FORMING APPARATUS WITH REDUCED LONG PERIOD GAP VARIATION

CROSS-REFERENCE TO RELATED APPLICATION

This patent application is based on and claims priority pursuant to 35 U.S.C. § 119(a) to Japanese Patent Application No. 2016-114374, filed on Jun. 8, 2016, in the Japan Patent Office, the entire disclosure of which is hereby incorporated by reference herein.

BACKGROUND

Technical Field

This disclosure relates to an image forming apparatus.

Related Art

Various types of image forming apparatuses are known to include a developing roller of a developing device that develops an electrostatic latent image formed on an image bearer such as a photoconductor into a visible image, and a drive device that drives to rotate a developer conveyance screw to convey developer stored in the developing device.

For example, a known image forming apparatus includes a drive device that has a first drive transmission passage and a second drive transmission passage. The first drive transmission passage includes a roller drive transmission passage through which a driving force is transmitted to a developer bearer such as a developing roller. The second drive transmission passage includes a screw drive transmission passage through which a driving force is transmitted to a different rotary body different from the developer bearer, such as a developer conveyance screw. A first joint such as a roller joint is provided to the first drive transmission passage, so that a driving force applied by a drive source is transmitted to the developer bearer via the first joint. A second joint such as a screw joint is provided to the second drive transmission passage, so that a driving force applied by the drive source is transmitted to the different rotary body.

SUMMARY

At least one aspect of this disclosure provides an image forming apparatus including an image bearer, a developing device, a drive source, a first joint, a rotary body, a second joint, and a drive device. The image bearer is configured to form a latent image on a surface thereof. The developing device is configured to develop the latent image formed on the image bearer to a visible image. The developing device includes a developer bearer configured to bear a developer on a surface thereof. The drive source is configured to apply a driving force. The drive device includes a first drive transmission passage and a second drive transmission passage. Through the first drive transmission passage, the driving force of the drive source is transmitted to the developer bearer via the first joint. Through the second drive transmission passage, the driving force of the drive source is transmitted to the rotary body via the second joint. The first drive transmission passage and the second drive transmission passage are defined such that one of a first drive transmission ratio from the drive source to the first joint of the first drive transmission passage and a second drive transmission ratio from the drive source to the second joint of the second drive transmission passage is an integral multiple of the other of the first drive transmission ratio from the drive source to the first joint of the first drive transmission passage and the second drive transmission ratio from the drive source to the second joint of the second drive transmission passage.

DETAILED DESCRIPTION

Figure 1:
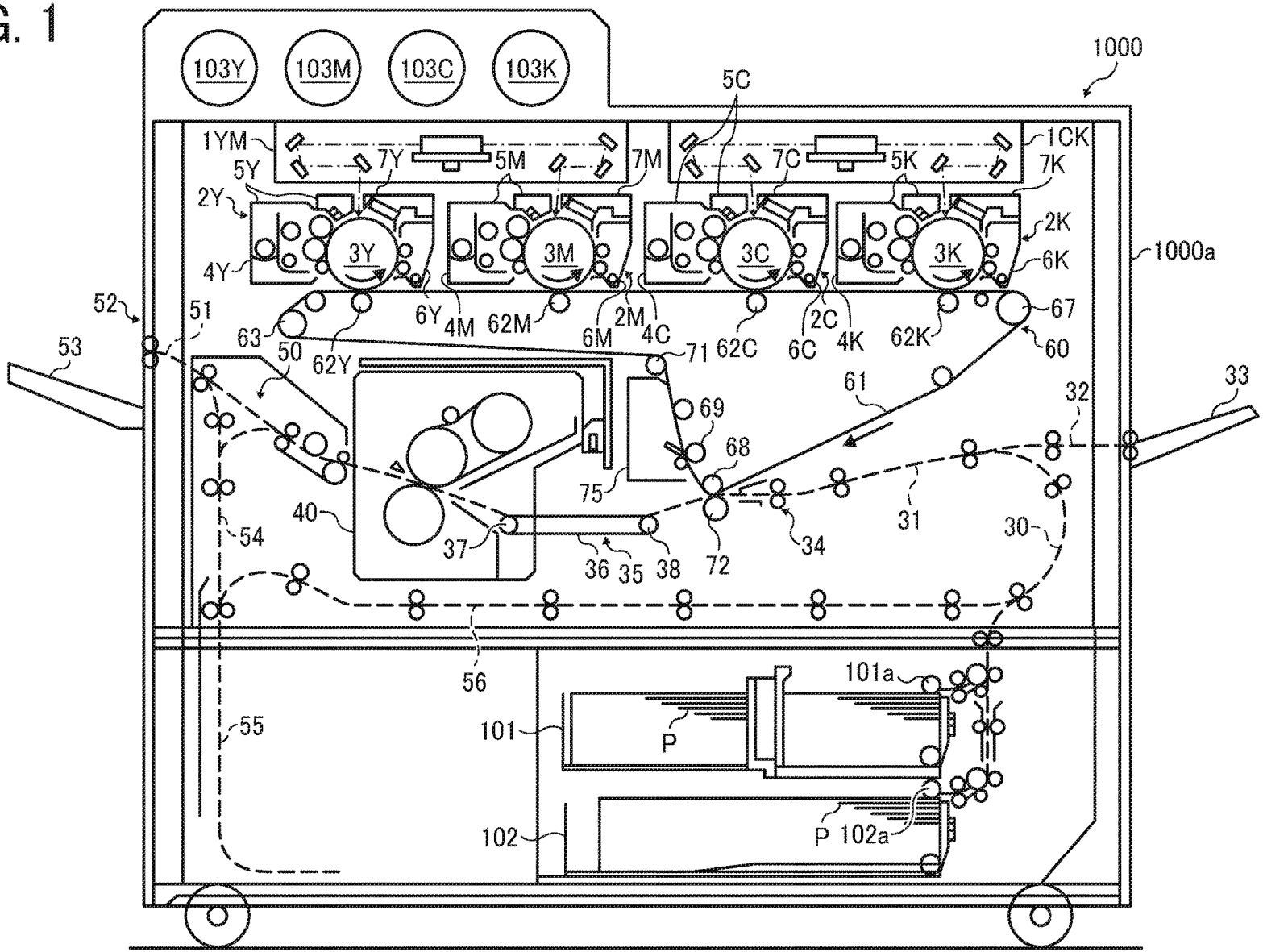
FIG. 1 is a schematic diagram illustrating an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

A description is given of a configuration and functions of an image forming apparatus according to an embodiment of this disclosure, with reference to drawings.

It is to be noted that identical parts are given identical reference numerals and redundant descriptions are summarized or omitted accordingly.

Now, a description is given of an electrophotographic printer for forming images by electrophotography. It is to be noted that, hereinafter, the electrophotographic image forming apparatus 1000 is referred to as the image forming apparatus 1000.

At first, a description is given of a basic configuration of the image forming apparatus 1000 according to an embodiment of this disclosure.

FIG. 1 is a schematic diagram illustrating the image forming apparatus 1000 according to an embodiment of this disclosure.

It is to be noted that identical parts are given identical reference numerals and redundant descriptions are summarized or omitted accordingly.

The image forming apparatus 1000 may be a copier, a facsimile machine, a printer, a multifunction peripheral or a multifunction printer (MFP) having at least one of copying, printing, scanning, facsimile, and plotter functions, or the like. According to the present example, the image forming apparatus 1000 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium;

and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying passage to a downstream side thereof; the term "width direction" indicates a direction basically perpendicular to the sheet conveying direction.

As illustrated in FIG. 1, the image forming apparatus 1000 includes two optical writing devices 1YM and 1CK, and four image forming units 2Y, 2M, 2C, and 2K to form respective toner images of yellow (Y), magenta (M), cyan (C), and black (K). Further, the image forming apparatus 1000 includes a sheet feed passage 30, a pre-transfer sheet conveyance passage 31, a bypass sheet feed passage 32, a bypass tray 33, a pair of registration rollers 34, a transfer belt device 35, a fixing device 40, a conveyance direction switching device 50, a sheet ejection passage 51, a pair of sheet output rollers 52, a sheet output tray 53, a first sheet container 101, a second sheet container 102, and a sheet re-entry device.

Each of the first sheet container 101 and the second sheet container 102 contains a bundle of recording sheets P that function as recording media. The bundle of recording sheets P includes a recording sheet P that functions as a recording medium. The first sheet container 101 includes a sheet feed roller 101*a* and the second sheet container 102 includes a sheet feed roller 102*a*. An uppermost recording sheet P that is placed on top of the bundle of recording sheets P is fed by rotation of a selected one of the sheet feed rollers 101*a* and 102*a* toward the sheet feed passage 30. The sheet feed passage 30 leads to the pre-transfer sheet conveyance passage 31 that extends to a secondary transfer nip region. The recording sheet P passes through the pre-transfer sheet conveyance passage 31 immediate before the secondary transfer nip region. After having been fed from a selected one of the first sheet container 101 and the second sheet container 102 and having passed through the sheet feed passage 30, the recording sheet P enters the pre-transfer sheet conveyance passage 31.

The bypass tray 33 is disposed openably and closably on a side of a housing 1000*a* of the image forming apparatus 1000. The bundle of recording sheets P can be loaded on a top face of the bypass tray 33 when the bypass tray 33 is rotated away from the housing 1000*a* to open. The uppermost recording sheet P placed on top of the bundle of recording sheets P on the bypass tray 33 is fed by a sheet feed roller included in the bypass tray 33 toward the pre-transfer sheet conveyance passage 31.

Each of the optical writing devices 1YM and 1CK includes a laser diode, a polygon mirror, and various lenses. Based on image data of an image that is optically read by a scanner disposed outside the housing 1000*a* or image data output from a personal computer disposed outside the housing 1000*a*, each of the optical writing devices 1YM and 1CK drives the laser diode. Consequently, respective photoconductors 3Y, 3M, 3C, and 3K of the image forming units 2Y, 2M, 2C, and 2K are optically scanned, respectively. Specifically, a drive device drives the photoconductors 3Y, 3M, 3C, and 3K of the image forming units 2Y, 2M, 2C, and 2K to rotate in a counterclockwise direction in FIG. 1.

The optical writing device 1YM emits laser light beams to the photoconductors 3Y and 3M by deflecting the laser light beams in an axial direction of rotation of the photoconductors 3Y and 3M. Accordingly, respective surfaces of the photoconductors 3Y and 3M are optically scanned and irradiated. Accordingly, an electrostatic latent image based on yellow image data is formed on the photoconductor 3Y and an electrostatic latent image based on magenta image data is formed on the photoconductors 3M.

Further, the optical writing device 1CK emits laser light beams to the photoconductors 3C and 3K by deflecting the laser light beams in an axial direction of rotation of the photoconductors 3C and 3K. Accordingly, respective surfaces of the photoconductors 3C and 3K are optically scanned and irradiated. Accordingly, an electrostatic latent image based on cyan image data is formed on the photoconductor 3C and an electrostatic latent image based on black image data is formed on the photoconductor 3K.

The image forming units 2Y, 2M, 2C, and 2K include the drum-shaped photoconductors 3Y, 3M, 3C, and 3K that function as latent image bearers, respectively. The image forming units 2Y, 2M, 2C, and 2K also include respective image forming units disposed around each of the photoconductors 3Y, 3M, 3C, and 3K as a single unit, respectively. The image forming units 2Y, 2M, 2C, and 2K are detachably attached to the housing 1000*a* of the image forming apparatus 1000. The image forming apparatus 1000 according to an embodiment of this disclosure is a tandem image forming apparatus in which the four image forming units 2Y, 2M, 2C, and 2K are aligned along a direction of movement of an intermediate transfer belt 61 as an endless loop. The image forming units 2Y, 2M, 2C, and 2K have respective configurations identical to each other except the colors of toners, and therefore are occasionally described without suffixes indicating the toner colors, which are yellow (Y), magenta (M), cyan (C), and black (K).

Now, a description is given of a configuration of the image forming unit using the image forming unit 2Y.

Figure 2:
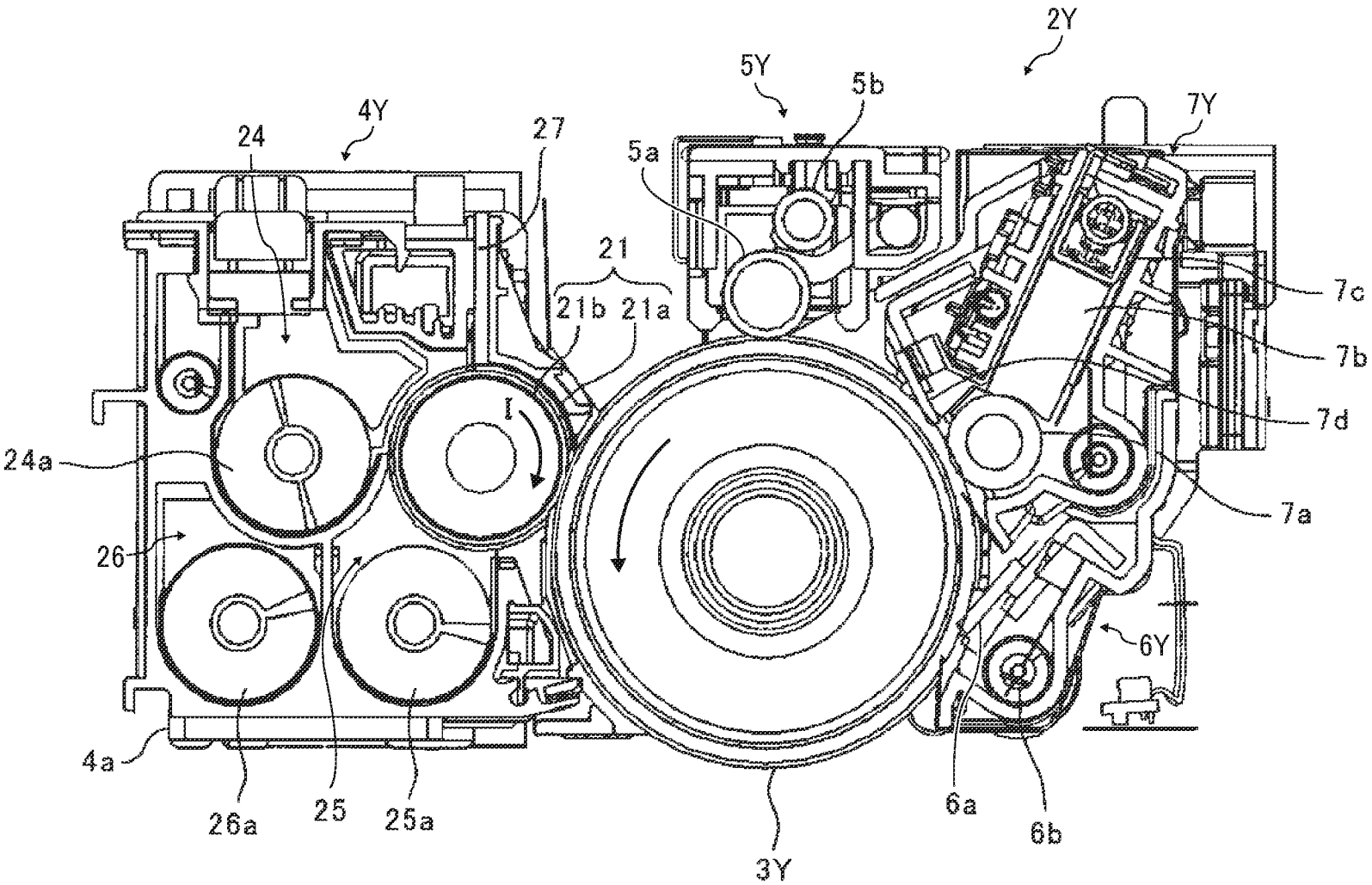
FIG. 2 is a schematic diagram illustrating a configuration of an image forming unit for forming a yellow toner image.

FIG. 2 is a schematic diagram illustrating the configuration of the image forming unit 2Y for forming a yellow toner image.

The image forming unit 2Y includes the photoconductor 3Y and a developing device 4Y that develops an electrostatic latent image formed on a surface of the photoconductor 3Y into a visible yellow toner image. The image forming unit 2Y further includes a charging device 5Y, a drum cleaning device 6Y, and a lubricant applying device 7Y. The charging device 5Y uniformly charges the surface of the photoconductor 3Y while the photoconductor 3Y is rotating. The drum cleaning device 6Y removes transfer residual toner remaining on the surface of the photoconductor 3Y after a primary transfer nip region for the yellow toner image and cleans the surface of the photoconductor 3Y. The lubricant applying device 7Y applies lubricant on the surface of the photoconductor 3Y.

The photoconductor 3 is manufactured by a hollow tube made of aluminum, for example, with a front face thereof covered by an organic photoconductive layer having photosensitivity.

It is to be noted that the photoconductors 3Y, 3M, 3C, and 3K may include an endless belt.

The charging device 5Y includes a charging roller 5*a* and a charging roller cleaner 5*b*. The charging roller 5*a* is disposed so as to contact the photoconductor 3Y. The charging roller cleaner 5*b* rotates while contacting the charging roller 5*a*.

The developing device 4 includes a developing roller 21 and a developing device casing 4*a*. The developing roller 21 functions as a developer bearer to supply the toner to an electrostatic latent image formed on the surface of the photoconductor 3Y while the surface thereof is moving in a direction indicated by arrow I in FIG. 2, and develops the electrostatic latent image.

It is to be noted that the image forming apparatus 1000 according to the present embodiment of this disclosure employs a two-component developer that includes toner and carrier particles. However, a one-component developer that includes toner but does not include carrier particles may be employed instead of the two-component developer.

The developing roller 21 is disposed facing the photoconductor 3Y with a predetermined development gap therebetween, through an opening of the developing device casing 4*a*. The developing roller 21 includes a developing sleeve 21*a* and a magnet roller 21*b*. The magnet roller 21*b* includes multiple magnets fixedly disposed inside the developing roller 21. The developing sleeve 21*a* is formed by an aluminum sleeve that contains the magnet roller 21*b* and rotates about the magnet roller 21*b*. The developing sleeve 21*a* rotates about the magnet roller 21*b* that forms multiple magnetic poles, and the developer moves on the developing roller 21 due to the rotation of the developing sleeve 21*a*.

A development power supply 301 (i.e., development power supplies 301Y, 301M, 301C, and 301K) (see FIG. 12) functions as a developing bias applying device to apply a developing bias to the developing sleeve 21*a* of the developing roller 21. By so doing, a development electric field is formed in a development region between the developing sleeve 21*a* and the photoconductor 3Y. Due to the development electric field, toner in the developer held on the surface of the developing sleeve 21*a* is supplied to the electrostatic latent image formed on the surface of the photoconductor 3Y in the development region.

The developing device casing 4*a* are provided with partition walls by which a developer supply passage 24, a developer collection passage 25, and a developer agitation passage 26 are divided. The developer supply passage 24 is provided on a lateral side of the developing roller 21. The developer collection passage 25 is provided below the developing roller 21. The developer agitation passage 26 is provided below the developer supply passage 24 and is aligned adjacent to the developer collection passage 25.

A developer supply screw 24*a* is provided to the developer supply passage 24. The developer supply screw 24*a* functions as a developer supplying body to convey the developer to a near side of the drawing sheet in FIG. 2 while supplying the developer to the developing sleeve 21*a*. The developer supply screw 24*a* supplies the developer to the developing sleeve 21*a* while conveying the developer from the far side toward the near side of the drawing sheet in a direction perpendicular to the drawing sheet of FIG. 2 along with the rotation thereof. The developer, which has not been supplied to the developing sleeve 21*a* and has been conveyed to an end of the near side of the developing device casing 4*a* in the direction perpendicular to the drawing sheet, is brought to fall to the developer agitation passage 26 disposed below the developer supply passage 24.

The developer that has been supplied to the developing sleeve 21*a* by the developer supply screw 24*a* is taken up onto the surface of the developing sleeve 21*a* due to a magnetic force generated by the magnet roller 21*b*. The developer that has been taken up onto the surface of the developing sleeve 21*a* rises on the developing sleeve 21*a* by the magnetic force generated by the magnet roller 21*b*, forming a magnetic brush. Along with rotation of the developing sleeve 21*a*, the developer passes through a regulation gap formed between a leading end of the developer regulation blade 27 and the developing sleeve 21*a*, so that the thickness of layer of the developer is regulated. Thereafter, the developer is conveyed to the development region facing the photoconductor 3Y.

In the development region, due to the developing bias that is applied to the developing sleeve 21*a*, out of the toner in the developer, a developing potential that applies an electrostatic force toward the electrostatic latent image affects to the toner facing the electrostatic latent image formed on the surface of the photoconductor 3Y. Further, out of the toner in the developer, a background potential that applies an electrostatic force toward the surface of the developing sleeve 21*a* affects to the toner facing the electrostatic latent image formed on the surface of the photoconductor 3Y. The results of the above-described actions cause the toner to transfer and adhere to the electrostatic latent image formed on the photoconductor 3Y, so that the electrostatic latent image is developed into a visible toner image. With this image forming operation, a yellow toner image is formed on the surface of the photoconductor 3Y. This yellow toner image enters into a primary transfer nip region along with rotation of the photoconductor 3Y.

After having passed through the development region along with rotation of the developing sleeve 21*a*, the developer is conveyed to a region where the magnetic force generated by the magnet roller 21*b* becomes weaker. According to this conveyance of the developer to the region, the developer falls from the surface of the developing sleeve 21*a* to the developer collection passage 25. The developer collection passage 25 includes a developer collection screw 25*a*. The developer that has fallen to the developer collection passage 25 is conveyed by the developer collection screw 25*a* from the far side to the near side of FIG. 2 in the direction perpendicular to the drawing sheet. Consequently, the developer conveyed to the end on the near side of the developing device 4Y in the direction perpendicular to the drawing sheet is passed to the developer agitation passage 26.

The developer agitation passage 26 includes a developer agitation screw 26*a*. The developer in the developer agitation passage 26 is conveyed by the developer agitation screw 26*a* from the near side to the far side of the developing device 4Y in FIG. 2 in the direction perpendicular to the drawing sheet. In the process of the above-described conveyance of the developer, a toner concentration sensor that includes a magnetic permeability sensor detects the toner concentration, and an appropriate amount of toner is supplied according to the detection result. This toner supply is performed by a controller by driving a toner supplying device including toner bottles 103Y, 103M, 103C, and 103K according to the detection result by the toner concentration sensor. The developer to which the appropriate amount of toner has been supplied is conveyed to the end on the far side of the developing device 4Y and is passed to the developer supply passage 24.

The drum cleaning device 6 includes a cleaning blade 6*a* and a developer discharge screw 6*b*. The cleaning blade 6*a* is a long elastic member extending in the axial direction of rotation of the photoconductor 3Y. An edge (a contact side edge) of the cleaning blade 6*a* extends in a direction in a longitudinal direction of the cleaning blade 6*a*. By pressing the edge of the cleaning blade 6*a* against the surface of the photoconductor 3Y, foreign material such as residual toner remaining on the surface of the photoconductor 3Y is separated and removed from the photoconductor 3Y. The residual toner removed from the photoconductor 3Y is discharged by the developer discharge screw 6*b* to the outside of the image forming unit 2Y.

The lubricant applying device 7Y includes a lubricant application brush roller 7*a*, a solid lubricant 7*b*, and a lubricant regulation blade 7*d*. The solid lubricant 7*b* is held by a bracket 7*c* and pressed to the lubricant application brush roller 7*a* by a pressing unit. The lubricant application brush roller 7*a* is rotated with the photoconductor 3Y in a direction of movement that is same as the photoconductor 3Y. The lubricant application brush roller 7*a* scrapes the solid lubricant 7*b* and applies the scraped solid lubricant 7*b* onto the photoconductor 3Y. An edge (a contact side edge) of the lubricant regulation blade 7*d* in a direction in a longitudinal direction of the lubricant regulation blade 7*d*. By pressing the edge of the lubricant regulation blade 7*d* against the surface of the photoconductor 3Y, the lubricant applied on the surface of the photoconductor 3Y is regulated to a uniform thickness.

An electric discharging lamp is disposed above the photoconductor 3Y. The electric discharging lamp is also included in the image forming unit 2Y. Further, the electric discharging lamp optically emits light to the photoconductor 3 to remove electricity from the surface of the photoconductor 3Y after the surface of the photoconductor 3Y has passed through the lubricant applying device 7Y. The discharged surface of the photoconductor 3Y is uniformly charged by the charging device 5Y. Then, the optical writing device 1YM starts optical scanning.

As previously described with the image forming unit 2Y illustrated in FIGS. 1 and 2, the image forming units 2K, 2M, 2C, and 2K have an identical configuration to each other.

As illustrated in FIG. 1, a transfer belt device 60 is disposed below the four image forming units 2Y, 2M, 2C, and 2K. The transfer belt device 60 causes the intermediate transfer belt 61 that is an endless belt wound around multiple support rollers 63, 67, 69, and 71 with tension. In the transfer belt device 60, while being in contact with the photoconductors 3Y, 3M, 3C, and 3K, the intermediate transfer belt 61 is rotated by rotation of one of the multiple support rollers 63, 67, 69, and 71 so that the intermediate transfer belt 61 endlessly moves in a clockwise direction of FIG. 1. By so doing, respective primary transfer nip regions for forming yellow, magenta, cyan, and black images are formed between the photoconductors 3Y, 3M, 3C, and 3K and the intermediate transfer belt 61.

In the vicinity of the primary transfer nip regions, primary transfer rollers 62Y, 62M, 62C, and 62K are disposed in a space surrounded by an inner circumferential surface of the intermediate transfer belt 61, that is, in a belt loop. The primary transfer rollers 62Y, 62M, 62C, and 62K, each of which functioning a primary transfer body, presses the intermediate transfer belt 61 toward the photoconductors 3Y, 3M, 3C, and 3K. A primary transfer bias is applied by respective transfer bias power supplies to the primary transfer rollers 62Y, 62M, 62C, and 62K. Consequently, respective primary transfer electric fields are generated in the primary transfer nip regions to electrostatically transfer respective toner images formed on the photoconductors 3Y, 3M, 3C, and 3K onto the intermediate transfer belt 61.

As the intermediate transfer belt 61 passes through the primary transfer nip regions along the endless rotation in the clockwise direction in FIG. 1, the yellow, magenta, cyan, and black toner images are sequentially transferred at the primary transfer nip regions and overlaid onto an outer circumferential surface of the intermediate transfer belt 61. This transferring operation is hereinafter referred to as primary transfer. Due to the primary transfer for primarily transferring the single color toner images, a composite toner image (hereinafter, referred to as a "four-color toner image") is formed on the outer circumferential surface of the intermediate transfer belt 61.

A secondary transfer roller 72 is disposed below the intermediate transfer belt 61, as illustrated in FIG. 1. The secondary transfer roller 72 that functions as a secondary transfer body contacts a secondary transfer backup roller 68 at a position at which the secondary transfer roller 72 faces the secondary transfer backup roller 68 via the outer circumferential surface of the intermediate transfer belt 61, which forms a secondary transfer nip region. By so doing, the secondary transfer nip region is formed between the outer circumferential surface the intermediate transfer belt 61 and the secondary transfer roller 72.

A secondary transfer bias is applied by a transfer bias power supply to the secondary transfer roller 72. By contrast, the secondary transfer backup roller 68 disposed inside the belt loop of the intermediate transfer belt 61 is electrically grounded. By so doing, a secondary transfer electric field is formed in the secondary transfer nip region.

The pair of registration rollers 34 is disposed on the right side of the secondary transfer nip region in FIG. 1. The pair of registration rollers 34 holds and conveys the recording sheet P to the secondary transfer nip region in synchronization with arrival of the four-color toner image formed on the intermediate transfer belt 61 so as to further convey the recording medium P toward the secondary transfer nip region. In the secondary transfer nip region, the four-color toner image formed on the intermediate transfer belt 61 is transferred onto the recording sheet P due to the secondary transfer electric field and a nip pressure. At this time, the four-color toner image is combined with white color of the recording medium P to make a full-color toner image.

Residual toner that has not been transferred onto the recording sheet P in the secondary transfer nip region remains on the outer circumferential surface of the intermediate transfer belt 61 after the intermediate transfer belt 61 has passed through the secondary transfer nip region. A belt cleaning device 75 that contacts the intermediate transfer belt 61 removes the residual toner remaining on the outer circumferential surface of the intermediate transfer belt 61.

The recording sheet P that has passed through the secondary transfer nip region separates from the intermediate transfer belt 61 to be conveyed to the transfer belt device 35. The transfer belt device 35 includes a transfer belt 36, a drive roller 37, and a driven roller 38. The transfer belt 36 having an endless belt is wound around the drive roller 37 and the driven roller 38 with taut and is endlessly rotated in the counterclockwise direction in FIG. 1 along with rotation of the drive roller 37. While holding the recording sheet P conveyed from the secondary transfer nip region on a stretched surface of an outer circumferential surface of the transfer belt 36, the transfer belt device 35 forwards the recording sheet P along with the endless rotation of the transfer belt 36 toward the fixing device 40.

The image forming apparatus 1000 according to the present embodiment of this disclosure further includes a sheet reversing device including a conveyance direction switching device 50, a re-entry passage 54, a switchback passage 55, and a post-switchback passage 56. Specifically, after receiving the recording sheet P from the fixing device 40, the conveyance direction switching device 50 switches a direction of conveyance of the recording sheet P, in other words, a direction in which the recording sheet P is further conveyed, between the sheet ejection passage 51 and the re-entry passage 54.

When printing an image on a first face of a recording sheet P and not printing on a second face, a single-side printing mode is selected. When performing a print job in the single-side printing mode, a route of conveyance of the recording sheet P is set to the sheet ejection passage 51. According to the setting, the recording sheet P having the image on the first face is conveyed toward the pair of sheet output rollers 52 via the sheet ejection passage 51 to be ejected to the sheet output tray 53 that is attached to the housing 1000*a* of the image forming apparatus 1000 from outside.

When printing images on both first and second faces of a recording sheet P, a duplex printing mode is selected. When performing a print job in the duplex printing mode, after the recording sheet P having fixed images on both first and second faces is conveyed from the fixing device 40, a route of conveyance of the recording sheet P is set to the sheet ejection passage 51. According to the setting, the recording sheet P having images on both first and second faces is conveyed toward the pair of sheet output rollers 52 via the sheet ejection passage 51 to be ejected to the sheet output tray 53 that is attached to the housing 1000*a* of the image forming apparatus 1000 from outside.

By contrast, when performing a print job in the duplex printing mode, after the recording sheet P having a fixed image on the first face is conveyed from the fixing device 40, a route of conveyance of the recording sheet P is set to the re-entry passage 54.

The re-entry passage 54 is connected to the switchback passage 55. The recording sheet P conveyed to the re-entry passage 54 enters the switchback passage 55. Consequently, when the entire region in the sheet conveying direction of the recording sheet P enters the switchback passage 55, the direction of conveyance of the recording sheet P is reversed, so that the recording sheet P is switched back in the reverse direction. The switchback passage 55 is connected to the post-switchback passage 56 as well as the re-entry passage 54. The recording sheet P that has been switched back in the reverse direction enters the post-switchback passage 56. At this time, the faces of the recording sheet P are reversed. Consequently, the reversed recording sheet P is conveyed to the secondary transfer nip region again via the post-switchback passage 56 and the sheet feed passage 30. A toner image is transferred onto the second face of the recording sheet P in the secondary transfer nip region. Thereafter, the recording sheet P is conveyed to the fixing device 40 so as to fix the toner image to the second face of the recording sheet P. Then, the recording sheet P passes through the conveyance direction switching device 50, the sheet ejection passage 51, and the pair of sheet output rollers 52 before being ejected on the sheet output tray 53.

Figure 3:
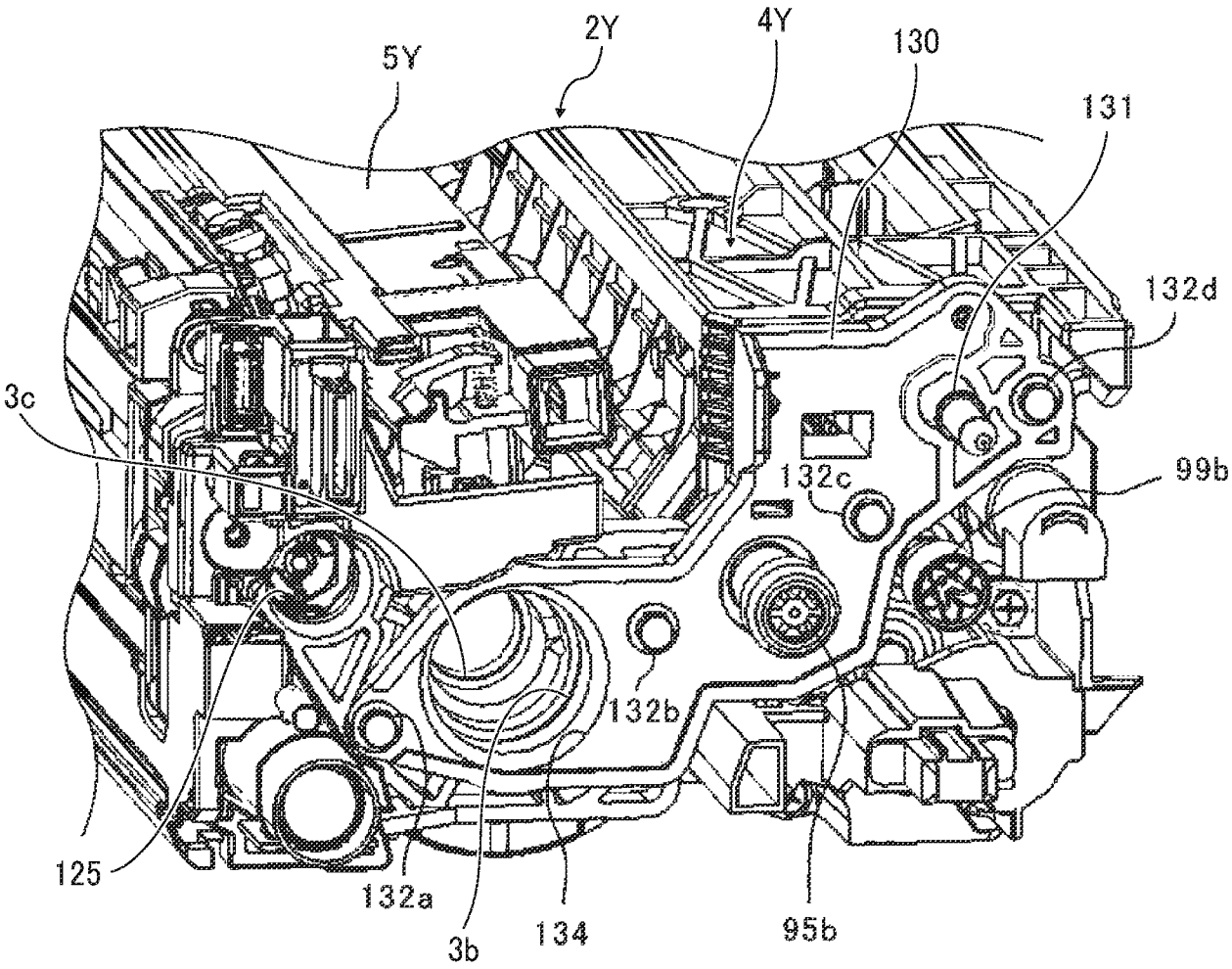
FIG. 3 is a perspective view illustrating a far side of the image forming unit.
Figure 4:
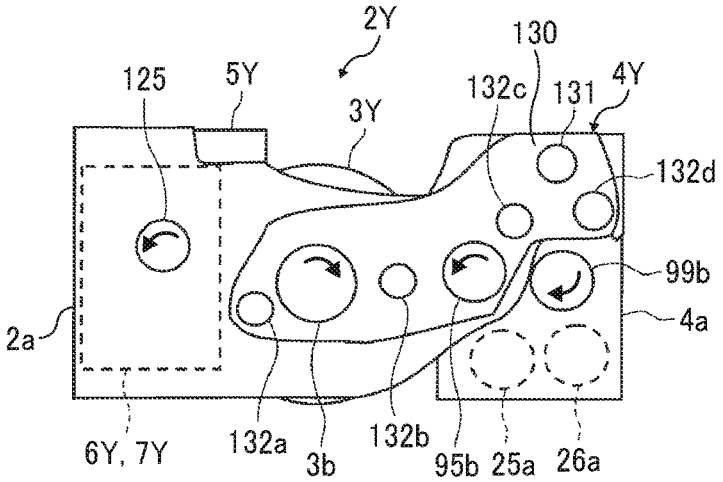
FIG. 4 is a schematic front view illustrating the far side of the image forming unit.
Figure 5:
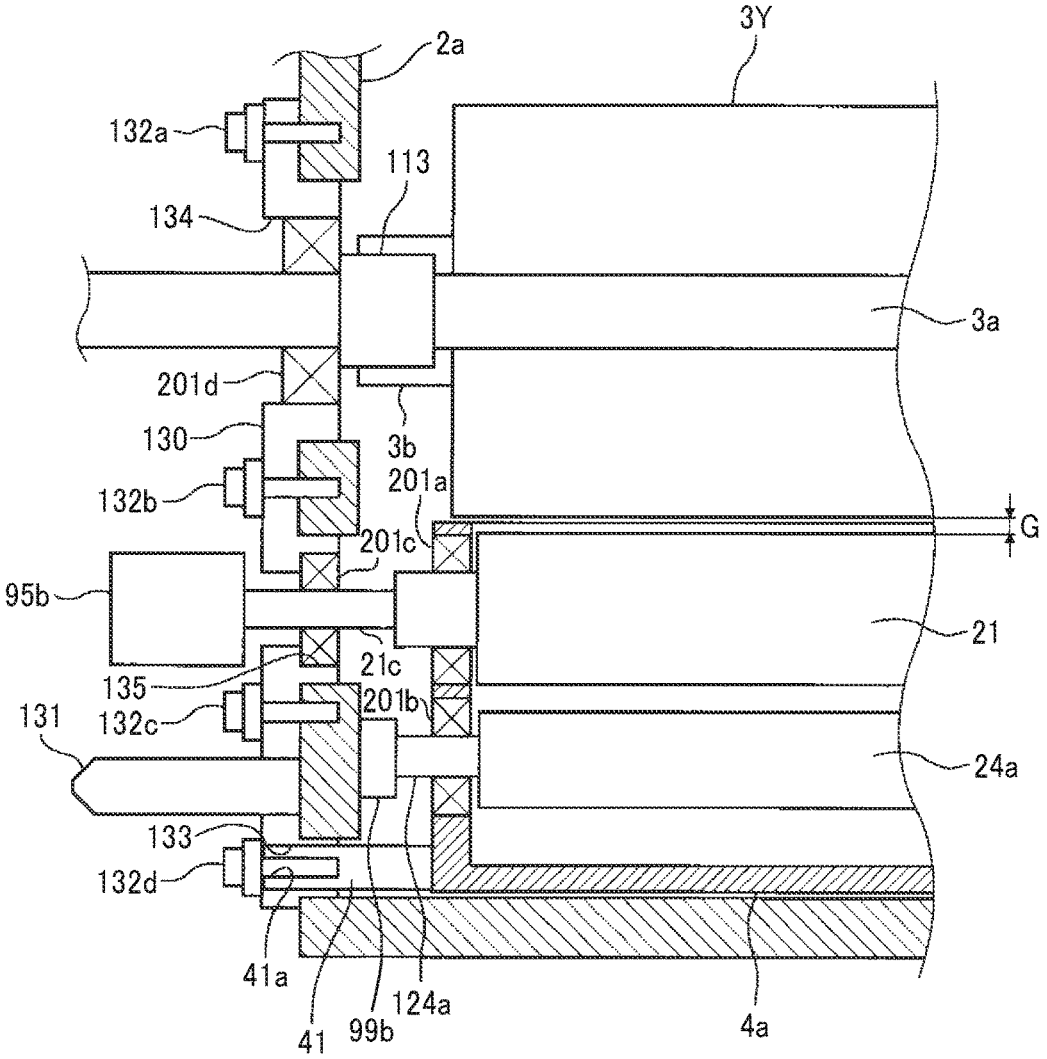
FIG. 5 is a schematic cross sectional view illustrating the far side of the image forming unit.

FIG. 3 is a perspective view illustrating the far side of the image forming unit 2Y. FIG. 4 is a schematic front view illustrating the far side of the image forming unit 2Y. FIG. 5 is a schematic cross sectional view illustrating the far side of the image forming unit 2Y.

As illustrated in FIG. 3, a positioning face plate 130 is attached to a side face on the far side of the image forming unit 2Y. The positioning face plate 130 positions the photoconductor 3Y and the developing roller 21 such that a development gap G between the photoconductor 3Y and the developing roller 21 is set to be a specified gap. As illustrated in FIG. 5, the positioning face plate 130 is positioned by fitting a positioning hole 133 to a positioning pin 41 that has a shaft 41*a* and mounted on the developing device casing 4*a*, and then screwed to a unit casing 2*a* of the image forming unit 2Y with screws 132*a*, 132*b*, and 132*c*. Further, the positioning face plate 130 is screwed to the positioning pin 41 with a screw 132*d*.

The positioning face plate 130 includes a photoconductor positioning hole 134 and a developing roller positioning hole 135. The photoconductor positioning hole 134 is an opening where the photoconductor 3Y is positioned. The developing roller positioning hole 135 is an opening where the developing roller 21 is positioned. As illustrated in FIG. 5, a photoconductor shaft 3*a* of the photoconductor 3Y is positioned at the photoconductor positioning hole 134 via a bearing 201*d*. By so doing, the photoconductor 3Y supported by the photoconductor shaft 3*a* is positioned. A developing roller shaft 21*c* of the developing roller 21 is positioned at the developing roller positioning hole 135 via a bearing 201*c*. By so doing, the developing roller 21 supported by the developing roller shaft 21*c* is positioned. Accordingly, the development gap G between the photoconductor 3Y and the developing roller 21 is positioned with a specified gap by the positioning face plate 130 at one axial end of the image forming unit 2Y. Further, another positioning face plate 130 is provided at the other axial end of the image forming unit 2Y. Similar to the one axial end, the development gap G between the photoconductor 3 and the developing roller 21 is also positioned with a specified gap by the positioning face plate 130 at the other axial end of the image forming unit 2Y.

Further, as illustrated in FIG. 5, the developing roller shaft 21*c* of the developing roller 21 is rotatably supported by the developing device casing 4*a* via a bearing 201*a* and the developer supply screw 24*a* is rotatably supported by the developing device casing 4*a* via a bearing 201*b*.

Further, as illustrated in FIG. 3, a photoconductor driven side coupling 3*b* is provided at one end on a far side of the photoconductor 3Y. As illustrated in FIG. 5, a photoconductor drive side coupling 113 is inserted into the photoconductor driven side coupling 3*b* to be drivingly coupled to each other. The photoconductor shaft 3*a* is mounted on the housing 1000*a*. By inserting the photoconductor shaft 3*a* of the photoconductor 3Y into a drum shaft opening 3*c* formed in the center of a flange of the photoconductor 3Y, the photoconductor 3Y is held by the photoconductor shaft 3*a*.

To position the image forming unit 2Y to the housing 1000*a*, an image forming unit positioning pin 131 that is mounted on the unit casing 2*a* of the image forming unit 2Y to pass through the positioning face plate 130 is inserted into an image forming unit positioning hole formed in the housing 1000*a*. Then, the photoconductor shaft 3*a* mounted on the housing 1000*a* is inserted into the photoconductor 3Y. Accordingly, the image forming unit 2Y is positioned to the housing 1000*a*.

A development driven side coupling 95*b* and a screw driven side coupling 99*b* are provided at the far side of the image forming unit 2Y. The development driven side coupling 95*b* is mounted on the developing roller shaft 21*c* of the developing roller 21. The screw driven side coupling 99*b* is mounted on a developer supply screw shaft 124*a* of the developer supply screw 24*a*. As illustrated in FIG. 3, a brush driven side coupling 125 is also provided at the far side of the image forming unit 2Y. The brush driven side coupling 125 is mounted on a brush shaft of the lubricant application brush roller 7*a*.

A gear is provided at the near side of the developer supply screw shaft 124*a*. A driving force is transmitted to the developer collection screw 25*a* and the developer agitation screw 26*a* via the gear, so as to drive and rotate the developer collection screw 25*a* and the developer agitation screw 26*a*. Another gear is provided at the near side of the brush shaft of the lubricant application brush roller 7*a*. A driving force is transmitted to the developer discharge screw 6*b* via the gear, so as to drive and rotate the developer discharge screw 6*b*.

The image forming units 2Y, 2M, 2C, and 2K have respective configurations identical to each other except the colors of toners, and therefore are occasionally described without suffixes indicating the toner colors, which are Y, M, C, and K. This occasional omission of suffixes is also applied to other units and components included in the image forming apparatus 1000 according to an embodiment of this disclosure.

Figure 6:
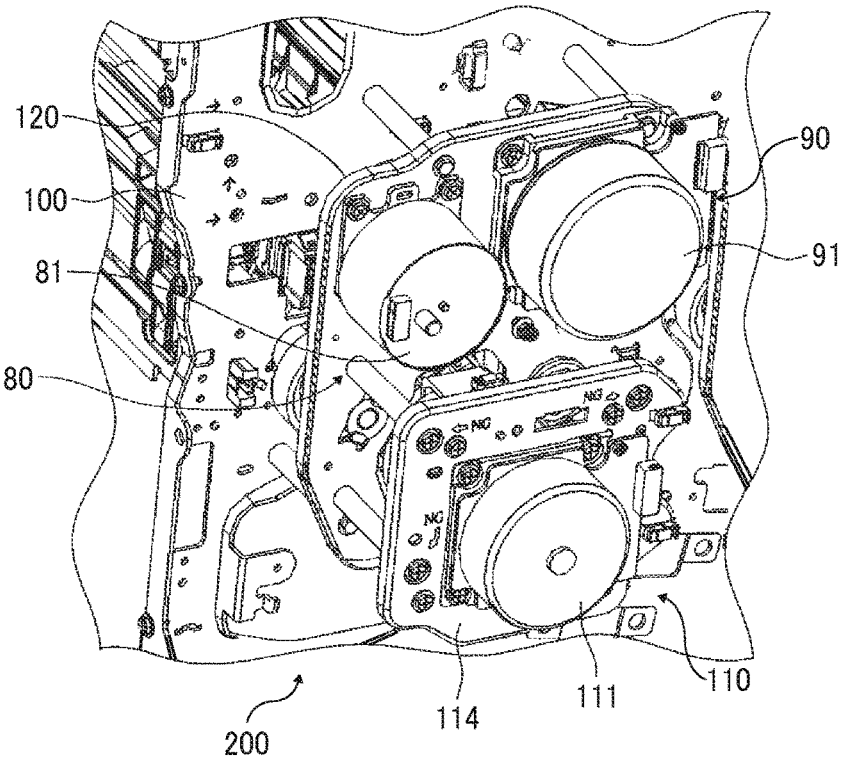
FIG. 6 is a perspective view illustrating a drive device that drives the image forming unit.

FIG. 6 is a perspective view illustrating a drive device 200 that drives the image forming unit 2 (i.e., the image forming units 2Y, 2M, 2C, and 2K).

The drive device 200 includes a photoconductor drive unit 110, a development drive unit 90, and a cleaning drive unit 80. The photoconductor drive unit 110 includes a photoconductor motor 111 that drives the photoconductor 3. The development drive unit 90 includes a developing motor 91 that drives rotary bodies included in the developing device 4Y such as the developing sleeve 21*a* and the screws, i.e., the developer supply screw 24*a*, the developer collection 25*a*, and the developer agitation screw 26*a*. The cleaning drive unit 80 includes a cleaning motor 81 that drives the lubricant application brush roller 7*a* and the developer discharge screw 6*b*. The developing motor 91 and the cleaning motor 81 are attached to a first motor attaching face plate 120. The first motor attaching face plate 120 is attached to the opposite side of a far side plate 100, that is the opposite side to a side facing the image forming unit 2. The photoconductor motor 111 is mounted on a second motor attaching face plate 114. The second motor attaching face plate 114 is attached to the first motor attaching face plate 120.

Figure 7:
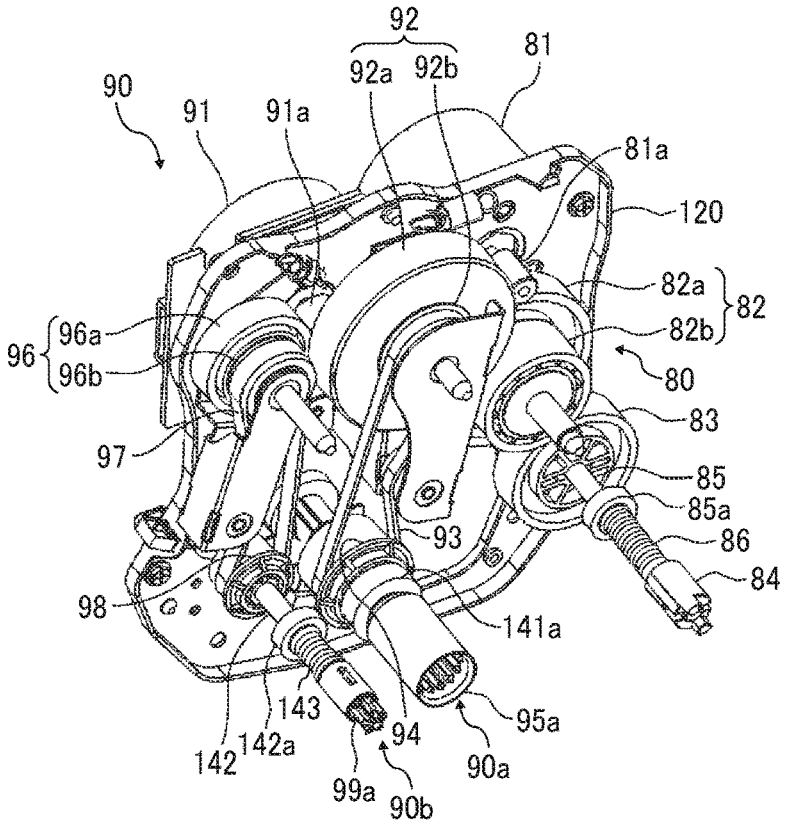
FIG. 7 is a perspective view illustrating a development drive unit and a cleaning drive unit of the drive device.
Figure 8:
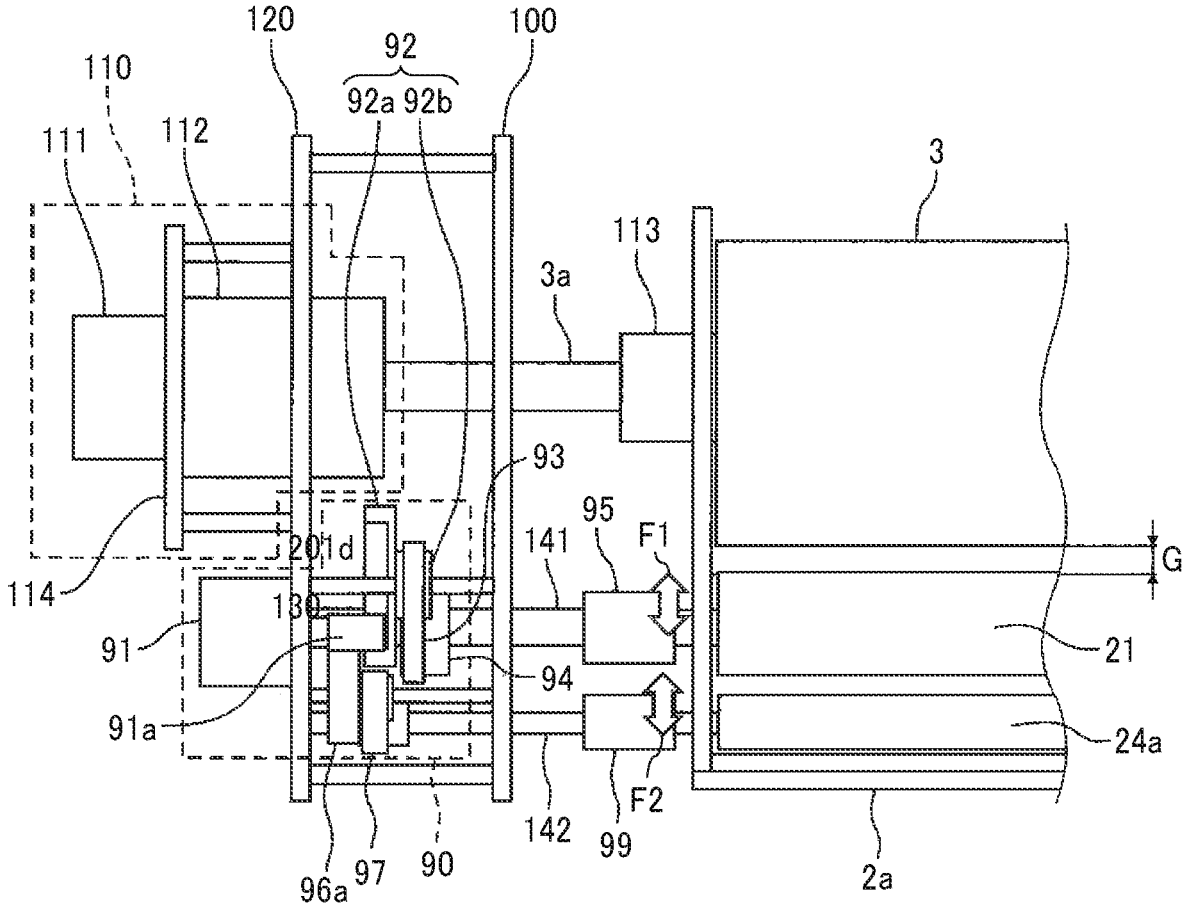
FIG. 8 is a schematic cross sectional view illustrating the development drive unit and a photoconductor drive unit of the drive device.

FIG. 7 is a perspective view illustrating the development drive unit 90 and the cleaning drive unit 80 of the drive device 200. FIG. 8 is a schematic cross sectional view illustrating the development drive unit 90 and the photoconductor drive unit 110 of the drive device 200.

As illustrated in FIG. 7, the cleaning drive unit 80 includes a cleaning drive input gear unit 82, a cleaning drive output gear 83, a cleaning drive output shaft 85, a brush drive side coupling 84, and a coil spring 86. The cleaning drive input gear unit 82 includes a first gear 82*a* and a second gear 82*b*. The first gear 82*a* is meshed with a motor gear 81*a* of the cleaning motor 81. The second gear 82*b* is meshed with the cleaning drive output gear 83. The cleaning drive output gear 83 is mounted on the cleaning drive output shaft 85 so as to rotate together with the cleaning drive output shaft 85 as a single unit. The cleaning drive output shaft 85 is rotatably supported by the far side plate 100 via a bearing 85*a*.

The brush drive side coupling 84 is mounted on the cleaning drive output shaft 85 to be slidable in the axial direction. The coil spring 86 is provided between the brush drive side coupling 84 and the bearing 85*a*. The brush drive side coupling 84 is drivingly coupled with the brush driven side coupling 125. By so doing, a driving force of the cleaning motor 81 is transmitted to the lubricant application brush roller 7*a*.

As illustrated in FIG. 8, the photoconductor drive unit 110 includes a photoconductor speed decreasing mechanism 112 transmits the driving force to the photoconductor shaft 3*a* at a decreased speed. The photoconductor speed decreasing mechanism 112 may preferably employ a planetary gear mechanism. The photoconductor speed decreasing mechanism 112 outputs the driving force to the photoconductor shaft 3*a*. The photoconductor drive side coupling 113 is mounted on the photoconductor shaft 3*a* so as to rotate together with the photoconductor shaft 3*a* as a single unit. The photoconductor drive side coupling 113 is inserted into the photoconductor drive side coupling 113 formed on the flange of the photoconductor 3. By so doing, the photoconductor drive side coupling 113 is drivingly coupled with the photoconductor driven side coupling 3*b*. Accordingly, the driving force of the photoconductor motor 111 is transmitted to the photoconductor 3.

As illustrated in FIGS. 7 and 8, the development drive unit 90 includes a sleeve drive transmission passage 90*a* and a screw drive transmission passage 90*b*. The sleeve drive transmission passage 90*a* functions as a first drive transmission passage to transmit the driving force of the developing motor 91 to the developing sleeve 21*a*. The screw drive transmission passage 90*b* transmits the driving force of the developing motor 91 to the developer supply screw 24*a*.

The sleeve drive transmission passage 90*a* includes a sleeve drive input member 92, a sleeve timing belt 93, a sleeve drive output pulley 94, a sleeve drive output shaft 141, and a development drive side coupling 95*a*. The screw drive transmission passage 90*b* includes a screw drive input member 96, a screw timing belt 97, a screw drive output pulley 98, a screw drive output shaft 142, a screw drive side coupling 99*a*, and a coil spring 143.

The sleeve drive input member 92 includes an internal gear 92*a* and a sleeve drive input pulley 92*b*. The internal gear 92*a* is meshed with the motor gear 91*a* of the developing motor 91. The sleeve timing belt 93 is wound around the sleeve drive input pulley 92*b* and the sleeve drive output pulley 94. The sleeve drive output pulley 94 is mounted on the sleeve drive output shaft 141 so as to rotate together with the sleeve drive output shaft 141 as a single unit. The sleeve drive output shaft 141 is rotatably supported by the far side plate 100 via a bearing 141*a*. The development drive side coupling 95*a* is mounted on the leading end of the sleeve drive output shaft 141 so as to rotate together with the sleeve drive output shaft 141 as a single unit. The development drive side coupling 95*a* has a tubular portion and internal teeth formed on an inner circumferential surface of the tubular portion. The development driven side coupling 95*b* is inserted into the development drive side coupling 95*a*, so as to be drivingly coupled with the development drive side coupling 95*a*. Accordingly, the driving force of the developing motor 91 is transmitted to the developing sleeve 21*a* via a developing joint 95 including the development drive side coupling 95*a* and the development driven side coupling 95*b*.

The screw drive input member 96 includes an external gear 96*a* and a screw drive input member 96. The external gear 96*a* is meshed with the motor gear 91*a* of the developing motor 91. The screw timing belt 97 is wound around the screw drive input pulley 96*b* and the screw drive output pulley 98. The screw drive output pulley 98 is mounted on the screw drive output shaft 142 so as to rotate together with the screw drive output shaft 142 as a single unit. The screw drive output shaft 142 is rotatably supported by the far side plate 100 via a bearing 142*a*. The screw drive side coupling 99*a* is mounted on the leading end of the screw drive output shaft 142 to be slidable in the axial direction and rotatable together with the screw drive output shaft 142 as a single unit. The coil spring 143 is provided between the screw drive side coupling 99*a* and the bearing 142*a*. The screw drive side coupling 99*a* is drivingly coupled with the screw driven side coupling 99*b*. Accordingly, the driving force of the developing motor 91 is transmitted to the developer supply screw 24*a* via a screw joint 99 including the screw drive side coupling 99*a* and the screw driven side coupling 99*b*.

In the present embodiment, a drive transmission ratio of the screw drive transmission passage 90*b* of the development drive unit 90 is set to be an integral multiple of a drive transmission ratio of the sleeve drive transmission passage 90*a* of the development drive unit 90. Consequently, the number of rotations of the screw joint 99 is an integral multiple of the number of rotations of the developing sleeve 21*a*. Specifically, by appropriately setting the number of teeth of the motor gear 91*a* of the developing motor 91, the number of teeth of the internal gear 92*a* of the sleeve drive transmission passage 90*a*, the number of teeth of the sleeve drive input pulley 92*b*, the number of teeth of the sleeve drive output pulley 94, the number of teeth of the external gear 96*a* of the screw drive transmission passage 90*b*, and the number of teeth of the screw drive input pulley 96*b*, the drive transmission ratio of the screw drive transmission passage 90*b* of the development drive unit 90 can be set to an integral multiple of the drive transmission ratio of the sleeve drive transmission passage 90*a* of the development drive unit 90. It is to be noted that, in a case in which the screw timing belt 97 and the sleeve timing belt 93 do not have teeth but use a frictional force to transmit the driving force of a V belt, the diameter of each pulley may be adjusted appropriately.

Any misalignment between the center of rotation axis of the sleeve drive output shaft 141 and the center of rotation axis of the developing roller shaft 21*c* of the developing roller 21 can cause due to manufacturing errors and assembly errors. Hereinafter, misalignment between the centers of rotation axis of these two shafts (i.e., the sleeve drive output shaft 141 and the developing roller shaft 21*c* of the developing roller 21) is referred to as "axis misalignment". In a case in which the development drive side coupling 95*a* and the development driven side coupling 95*b* are drivingly coupled with each other in a state of axis misalignment, a shaft reaction force F1 is generated at the sleeve drive output shaft 141 in the developing joint 95, as illustrated in FIG. 8. This shaft reaction force F1 at the sleeve drive output shaft 141 periodically varies in one period including one rotation of the developing joint 95. In the present embodiment, the driving force is transmitted from the developing joint 95 to the developing sleeve 21*a* without any gear interposed therebetween. Therefore, the rotation period of the developing joint 95 is same as the rotation period of the developing sleeve 21*a*.

Similarly, in a case in which the screw drive output shaft 142 and the developer supply screw shaft 124*a* have an axis misalignment, a shaft reaction force F2 is generated at the screw drive output shaft 142 in the screw joint 99. The shaft reaction force F2 at the screw drive output shaft 142 periodically varies in one period including one rotation of the screw joint 99. In the present embodiment, the driving force is transmitted from the screw joint 99 to the developer supply screw 24*a* without any gear interposed therebetween. Therefore, the rotation period of the screw joint 99 is same as the rotation period of the developer supply screw 24*a*.

When the shaft reaction force F1 is generated in the developing joint 95, the developing roller shaft 21*c* of the developing roller 21 tends to move in a direction approaching the photoconductor 3 or a direction separating from the photoconductor 3 due to the shaft reaction force F1. As illustrated in FIG. 5, the developing roller shaft 21*c* of the developing roller 21 is rotatably supported by the developing device casing 4*a* via the bearing 201*a* and by the positioning face plate 130 via the bearing 201*c*. However, there is a relatively small gap between the positioning face plate 130 and the bearing 201*c*. As a result, the developing roller 21 approaches or separates relative to the photoconductor 3 at the rotation period of the developing sleeve 21*a* due to the shaft reaction force F1, and therefore the development gap G between the photoconductor 3 and the developing roller 21 varies. Further, the developing roller 21 also approaches or separates relative to the photoconductor 3 at the rotation period of the developing sleeve 21*a* due to eccentricity of the developing sleeve 21*a* and strain of an outer diameter of the developing sleeve 21*a*, and therefore the development gap G between the photoconductor 3 and the developing roller 21 varies. As described above, due to variations of the development gap G, the development electric field generated between the photoconductor 3 and the developing sleeve 21*a* varies, and therefore image density nonuniformity is generated at the rotation period of the developing sleeve 21*a*.

The shaft reaction force F2 generated at the developer supply screw 24*a* in the screw joint 99 is added to the developing device casing 4*a* via the bearing 201*b* that receives the developer supply screw shaft 124*a*. The shaft reaction force F2 of the screw joint 99 added to the developing device casing 4*a* is added to the developing roller shaft 21*c* of the developing roller 21 via the bearing 201*a* that receives the developing roller shaft 21*c*. As a result, the developing roller 21 approaches and separates relative to the photoconductor 3 at the rotation period of the screw joint 99 (i.e., the developer supply screw 24*a*) due to the shaft reaction force F2. Therefore, the development gap G between the photoconductor 3 and the developing roller 21 varies. Consequently, due to the variations of the development gap G, image density nonuniformity is generated at the rotation period of the screw joint 99 (i.e., the developer supply screw 24*a*).

Figure 9:
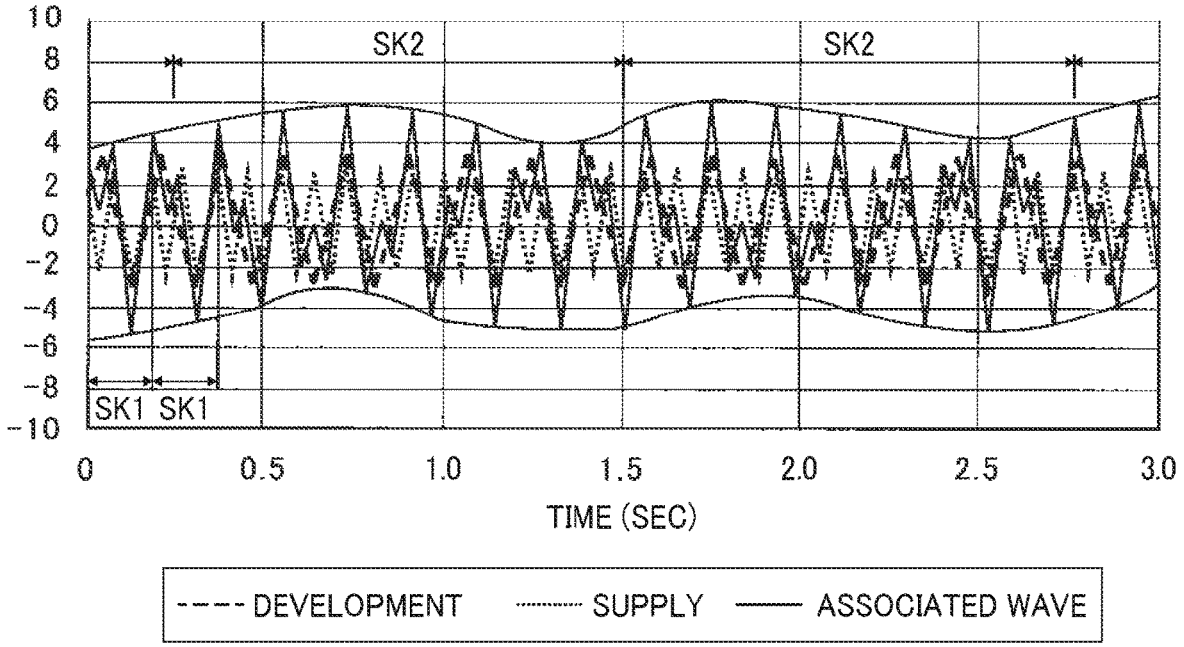
FIG. 9 is a graph of results of simulation of variations in a developing gap under conditions that the number of rotations of the developing sleeve is set to 5.8 rpm and the number of rotations of the screw joint is set to 10.8 rpm.

FIG. 9 is a graph of results of simulation of variations in the development gap G under conditions that the number of rotations of the developing sleeve 21*a* is set to 5.8 rpm and the number of rotations of the screw joint 99 is set to 10.8 rpm.

As illustrated in the graph in FIG. 9, a dashed line indicates a gap variation component that varies at the rotation period of the developing sleeve 21*a* generated due to the shaft reaction force F1 in the developing joint 95 or distortion of the outer diameter of the developing sleeve 21*a*, a broken line indicates a gap variation component that varies at the rotation period of the screw joint 99 (i.e., the developer supply screw 24*a*) generated due to the shaft reaction force F2 in the screw joint 99, and a solid line indicates a synthetic variation component that is synthesized by these variation components.

As illustrated in FIG. 9, when the drive transmission ratio of the screw drive transmission passage 90*b* of the development drive unit 90 is not an integral multiple of the drive transmission ratio of the sleeve drive transmission passage 90*a* of the development drive unit 90 and the number of rotations of the screw joint 99 is not an integral multiple of the number of rotations of the developing sleeve 21*a*, the variations in the development gap G has short period variation characteristics with one period including a period SK1 in FIG. 9 and long period variation characteristics with one period including a period SK2 in FIG. 9. Due to generation of a long period gap variation, when compared with image density nonuniformity of each page after image formation, image density nonuniformity (aspect of variations in image density and amplitudes of the variations in image density) becomes different depending on pages.

Figure 10:
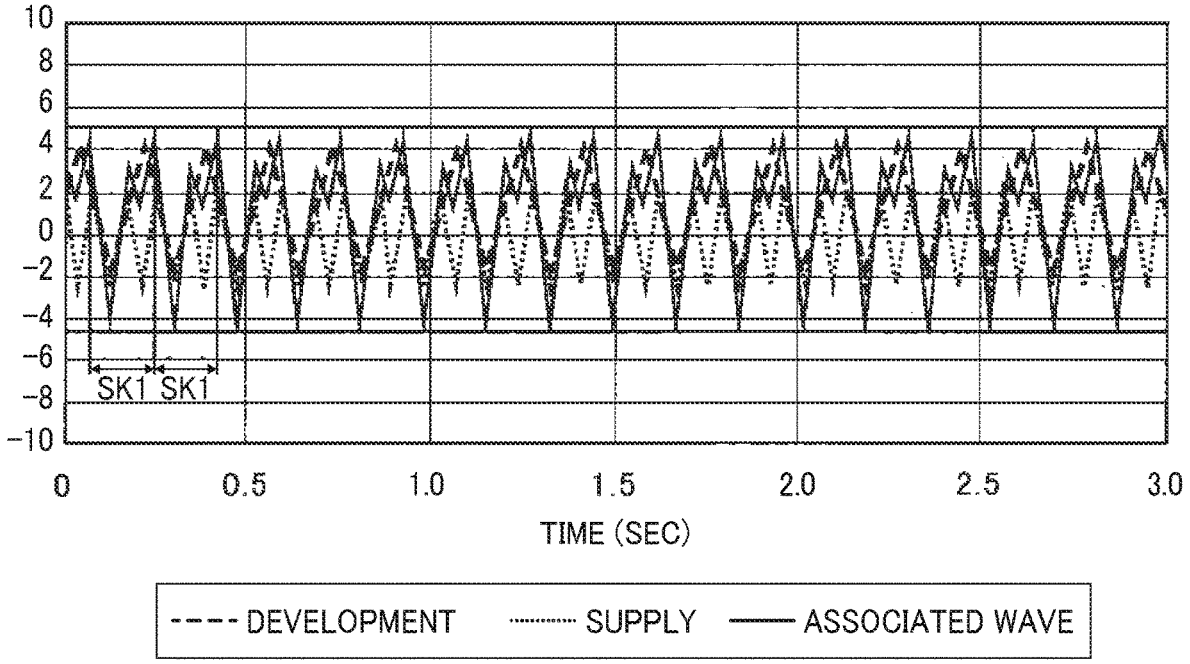
FIG. 10 is a diagram illustrating results of simulation of variations in a developing gap under conditions that the number of rotations of the developing sleeve is set to 5.8 rpm and the number of rotations of the screw joint is set to 11.6 rpm.

FIG. 10 is a graph of results of simulation of variations in the development gap G under conditions that the number of rotations of the developing sleeve 21*a* is set to 5.8 rpm and the number of rotations of the screw joint 99 is set to 11.6 rpm.

As can be seen from the graph of FIG. 10, when the drive transmission ratio of the screw drive transmission passage 90*b* of the development drive unit 90 is set to be an integral multiples (two times) of the drive transmission ratio of the sleeve drive transmission passage 90*a* of the development drive unit 90, the gap variation of the development gap G has the short period variation characteristics including the period SK1 alone. Due to this setting, the long period image density nonuniformity generated by the long period gap variation is no longer generated, and therefore the difference of image density nonuniformity depending pages can be restrained.

Further, in the above-described state, the driving force of the developing motor 91 can be transmitted to the developer collection screw 25*a* via the screw joint 99, and then transmitted from the developer collection screw 25*a* to the developer supply screw 24*a* or the developer agitation screw 26*a*. Alternatively, the driving force can be transmitted to the developer agitation screw 26*a* via the screw joint 99, and then transmitted from the developer agitation screw 26*a* to the developer supply screw 24*a* or the developer collection screw 25*a*.

In the present embodiment, the driving force is transmitted from the developing joint 95 to the developing sleeve 21*a* without any gear interposed therebetween. Therefore, the number of rotations of the developing joint 95 is equal to the number of rotations of the developing sleeve 21*a*. Consequently, the number of rotations of the screw joint 99 is an integral multiple (one time) of the number of rotations of the developing sleeve 21*a*. However, in a case in which the driving force is transmitted from the developing joint 95 to the developing sleeve 21*a* via a gear or gears, the period of the variation component of the development gap caused by the shaft reaction force F1 of the developing joint 95 and the period of the variation component of the development gap caused by distortion of the outer diameter of the developing sleeve 21*a* are likely to be any values other than an integral multiple of the number of rotations of the developing sleeve 21*a*. In this case, the long period gap variation is likely to be generated due to the gap variation component at the rotation period of the developing joint 95 caused by the shaft reaction force F1 of the developing joint 95. Therefore, in a case in which the driving force is transmitted from the developing joint 95 to the developing sleeve 21*a* via a gear or gears, a drive transmission passage from the developing joint 95 to the developing sleeve 21*a* is provided such that the number of rotations of the developing joint 95 is an integral multiple of the number of rotations of the developing sleeve 21*a*.

Further, the number of rotations of the developing motor 91 is preferably equal to an integral multiple of the number of rotations of the developing sleeve 21*a*. There is a case that the developing motor 91 vibrates with the period of the developing motor 91 due to eccentricity of a motor gear of the developing motor 91. When this vibration is transmitted to the developing sleeve 21*a*, the developing sleeve 21*a* vibrates. Therefore, it is likely that the development gap G varies. In a case in which the number of rotations of the developing motor 91 is not an integral multiple of the number of rotations of the developing sleeve 21*a*, as in the case in the graph of FIG. 9, the long period gap variation occurs, and therefore it is likely that the image density nonuniformity between pages becomes different.

However, by setting the number of rotations of the developing motor 91 to be equal to an integral multiple of the number of rotations of the developing sleeve 21*a*, the gap variation in the development gap G has the short period variation characteristics alone, as in the case in the graph of FIG. 10, and therefore the difference of image density nonuniformity depending pages can be further restrained.

Further, in a case in which the vibration of the photoconductor motor 111 and the vibration of the cleaning motor 81 are transmitted to the sleeve drive output shaft 141 via the first motor attaching face plate 120 and the far side plate 100, respectively, the vibration eventually vibrates the developing sleeve 21*a*. Therefore, it is likely to vary the development gap. Accordingly, the number of rotations of the photoconductor motor 111 and the number of rotations of the cleaning motor 81 are also preferable to be integral multiples of the developing sleeve 21*a*.

Further, when the drive transmission ratio of the screw drive transmission passage 90*b* of the development drive unit 90 is set to be an integral multiple of the drive transmission ratio of the sleeve drive transmission passage 90*a* of the development drive unit 90, the periodic image density nonuniformity can be preferably corrected by correction of image density nonuniformity based on a specific rotation position of the developing sleeve 21*a*.

Figure 11A:
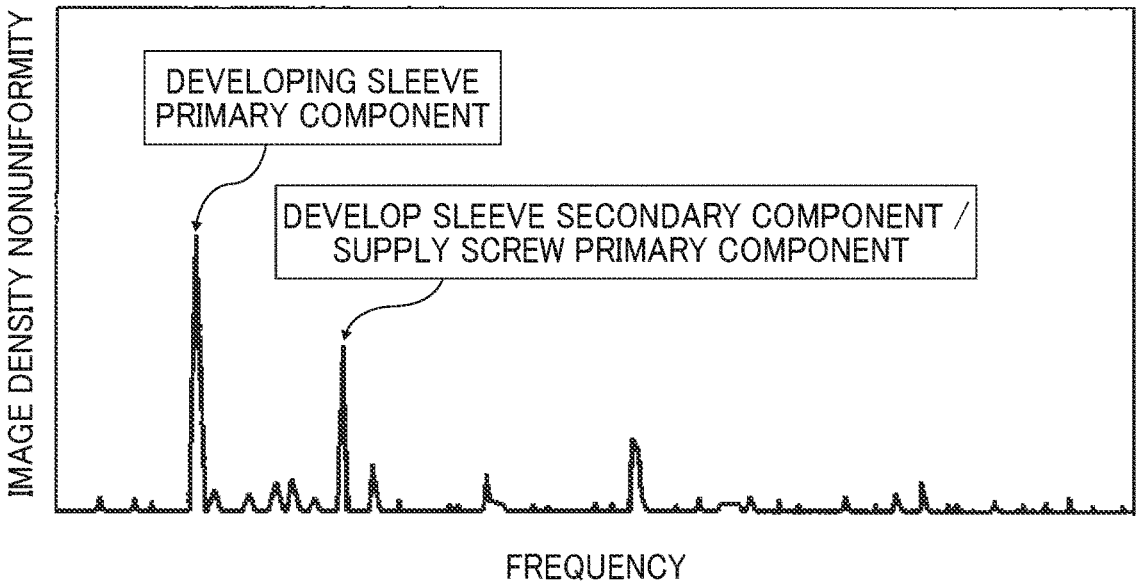
FIG. 11A is a graph illustrating peaks of periodic variations in image density nonuniformity when a drive transmission ratio of a screw drive transmission passage of the development drive unit is set to be two times as a drive transmission ratio of a sleeve drive transmission passage.
Figure 11B:
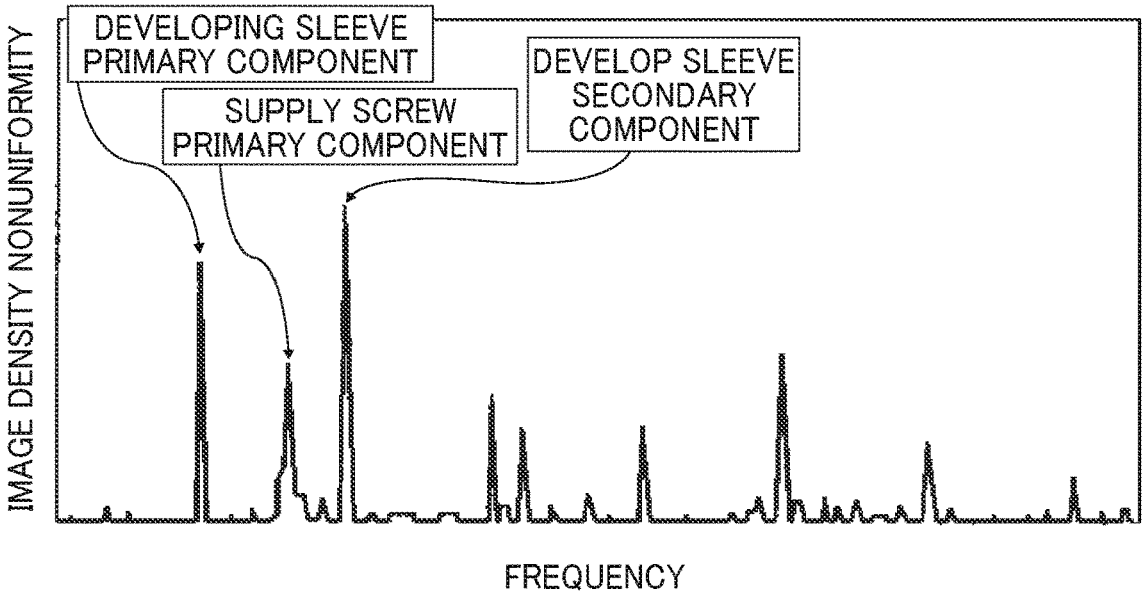
FIG. 11B is a graph illustrating peaks of periodic variations in image density nonuniformity when the drive transmission ratio of the screw drive transmission passage of the development drive unit is set to be integral multiples of the drive transmission ratio of the sleeve drive transmission passage.

FIG. 11A is a graph illustrating peaks of periodic variations in image density nonuniformity when the drive transmission ratio of the screw drive transmission passage 90*b* of the development drive unit 90 is set to be two times as the drive transmission ratio of the sleeve drive transmission passage 90*a*. FIG. 11B is a graph illustrating peaks of periodic variations in image density nonuniformity when the drive transmission ratio of the screw drive transmission passage 90*b* of the development drive unit 90 is set to be integral multiples of the drive transmission ratio of the sleeve drive transmission passage.

As illustrated in FIG. 11A, when the drive transmission ratio of the screw drive transmission passage 90*b* of the development drive unit 90 is set to be two times as the drive transmission ratio of the sleeve drive transmission passage 90*a*, the periodic variation components of the image density indicating the peak become a primary (one time) frequency component of the number of rotations of the developing sleeve 21*a* and a secondary (two times) frequency component of the number of rotations of the developing sleeve 21*a*. Therefore, by correcting the image density nonuniformity of the primary (one time) frequency component of the number of rotations of the developing sleeve 21*a* and the image density nonuniformity of the secondary (two times) frequency component of the number of rotations of the developing sleeve 21*a*, the periodic variations in image density nonuniformity can be restrained.

By contrast, as illustrated in FIG. 11B, when the drive transmission ratio of the screw drive transmission passage 90*b* of the development drive unit 90 is not set to be an integral multiple of the drive transmission ratio of the sleeve drive transmission passage 90*a*, there are multiple periodic variation components of the image density indicating the peak other than the primary (one time) frequency component of the number of rotations of the developing sleeve 21*a* and the secondary (two times or double) frequency component of the number of rotations of the developing sleeve 21*a*. Therefore, even though the image density nonuniformity of the primary (one time) frequency component of the number of rotations of the developing sleeve 21*a* and the image density nonuniformity of the secondary (two times or double) frequency component of the number of rotations of the developing sleeve 21*a* are corrected, multiple periodic variations of image density nonuniformity remain, and therefore the image density nonuniformity cannot be corrected sufficiently.

Next, a description is given of correction of image density nonuniformity according to the present embodiment of this disclosure.

Figure 12:
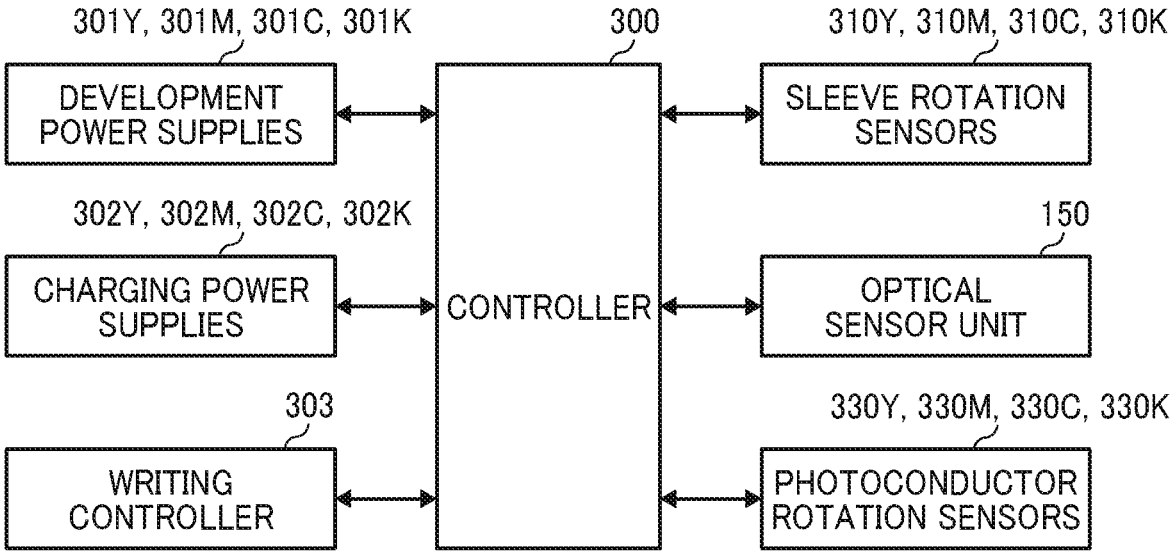
FIG. 12 is a block diagram illustrating a main part of an electric circuit of the image forming apparatus.

FIG. 12 is a block diagram illustrating a main part of an electric circuit of the image forming apparatus 1000 according to the present embodiment of this disclosure.

In FIG. 12, the image forming apparatus 1000 includes a controller 300 that functions as a control unit. The controller 300 includes a central processing unit (CPU), a random access memory (RAM), a read only memory (ROM), and a nonvolatile memory. The controller 300 is electrically connected to development power supplies 301Y, 301M, 301C, and 301K for developing yellow, magenta, cyan, and black images, respectively. The controller 300 outputs respective control signals to the development power supplies 301Y, 301M, 301C, and 301K, individually. By so doing, respective values of the developing bias output from the development power supplies 301Y, 301M, 301C, and 301K can be adjusted individually. Specifically, the controller 300 can adjust respective values of developing biases to be applied to each developing sleeve 21*a* of the developing devices 4Y, 4M, 4C, and 4K individually.

Further, the controller 300 is electrically connected to charging power supplies 302Y, 302M, 302C, and 302K for charging the surfaces of the photoconductors 3Y, 3M, 3C, and 3K, respectively. The controller 300 outputs respective control signals to the charging power supplies 302Y, 302M, 302C, and 302K, individually. By so doing, respective values of direct current voltages of the charging biases output from the charging power supplies 302Y, 302M, 302C, and 302K can be adjusted individually. Specifically, the controller 300 can adjust respective values of direct current voltages of the charging biases to be applied to each charging roller 5*a* of the charging devices 5Y, 5M, 5C, and 5K individually.

Further, the controller 300 is electrically connected to sleeve rotation sensors 310Y, 310M, 310C, and 310K to individually detect that the developing sleeves 21*a* of the developing devices 4Y, 4M, 4C, and 4K are at respective predetermined positions of rotation. The controller 300 can grasp the developing sleeves 21*a* of the developing devices 4Y, 4M, 4C, and 4K are at respective predetermined positions of rotation based on respective outputs of the sleeve rotation sensors 310Y, 310M, 310C, and 310K.

Further, the controller 300 is electrically connected to photoconductor rotation sensors 330Y, 330M, 330C, and 330K, respectively. According to the same configuration as the sleeve rotation sensors 310Y, 310M, 310C, and 310K illustrated in FIG. 13, the photoconductor rotation sensors 330Y, 330M, 330C, and 330K detect that the photoconductors 3Y, 3M, 3C, and 3K are at respective predetermined positions of rotation. That is, the controller 300 can individually grasp respective timings when the photoconductors 3Y, 3M, 3C, and 3K are come to respective predetermined positions of rotation based on respective outputs of the photoconductor rotation sensors 330Y, 330M, 330C, and 330K.

Further, the controller 300 is electrically connected to a writing controller 303 and an optical sensor unit 150.

The writing controller 303 controls respective drivings of the optical writing devices 1YM and 1CK based on image data. The controller 300 outputs respective control signals to the writing controller 303, so that the controller 300 can individually control a light amount of writing to emit to the photoconductors 3Y and 3M from the optical writing device 1YM and the photoconductors 3C and 3K from the optical writing device 1CK.

It is to be noted that the role of the optical sensor unit 150 is described below.

Figure 13:
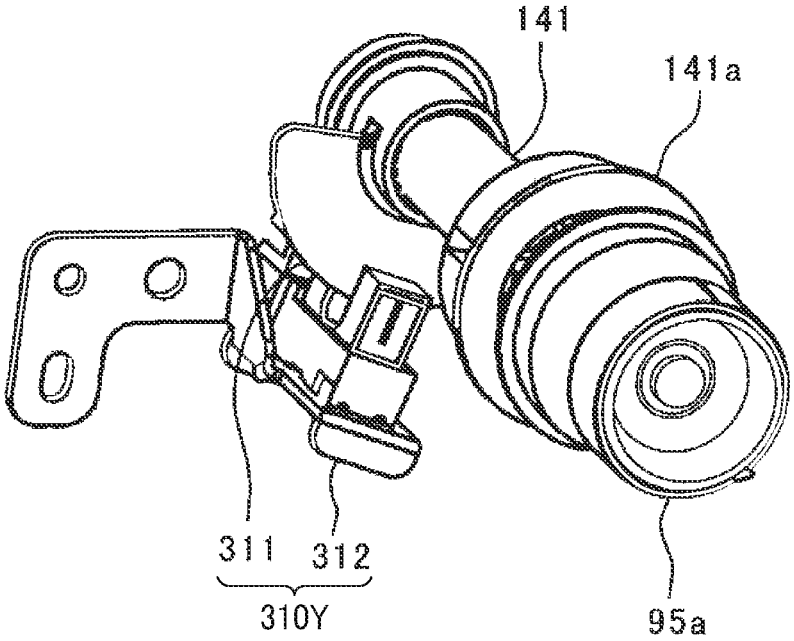
FIG. 13 is a perspective view illustrating a sleeve rotation sensor of the yellow toner image.

FIG. 13 is a perspective view illustrating of the sleeve rotation sensor 310Y for forming a yellow toner image.

The sleeve rotation sensor 310Y includes a shielding member 311 and a transmission photosensor 312. The shielding member 311 is fixed to the sleeve drive output shaft 141 and rotates together with the sleeve drive output shaft 141 as a single unit. The sleeve drive output shaft 141 projects in a normal direction at a predetermined position on the circumferential surface of the sleeve drive output shaft 141. When the developing sleeve 21*a* is brought to the predetermined position of rotation, the shielding member 311 is interposed between a light emitting element and a light receiving element of the transmission photosensor 312. Accordingly, the light receiving element does not receive light. Consequently, the output voltage value significantly drops. That is, when the developing sleeve 21*a* comes to the predetermined position of rotation, the transmission photosensor 312 detects the state, and therefore greatly reduces the output voltage value. The sleeve rotation sensors 310M, 310C, and 310K for magenta, cyan, and black toner images have the same configuration and functions.

Figure 14:
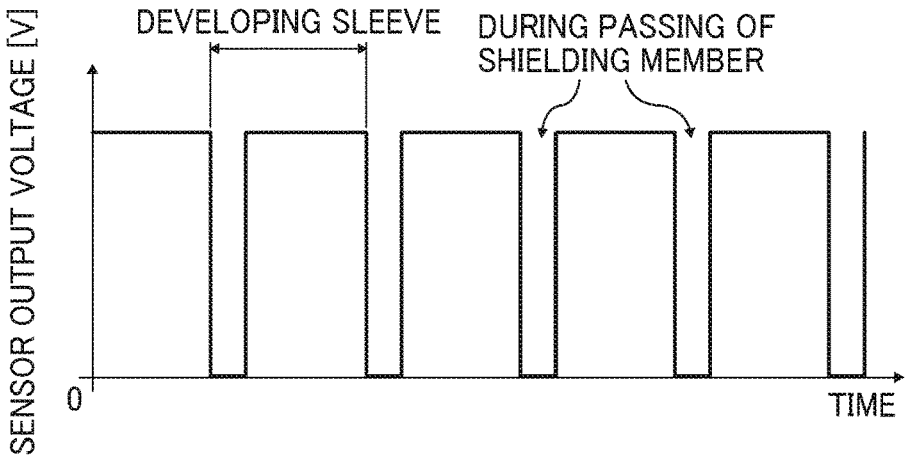
FIG. 14 is a graph illustrating perspective view illustrating changes of an output voltage form the sleeve rotation sensor with time.

FIG. 14 is a graph illustrating changes of a sensor output voltage form the sleeve rotation sensor 310Y with time. It is to be noted that the sensor output voltage from the sleeve rotation sensor 310Y corresponds to an output voltage from the transmission photosensor 312.

As illustrated in the graph of FIG. 14, when the developing roller 21 is rotating, the voltage of 6V is output from the sleeve rotation sensor 310Y for most of the time. However, each time the developing sleeve 21*a* rotates for one period, the output voltage from the sleeve rotation sensor 310Y significantly drops approximately to 0V. The sharp drop of the output voltage from the sleeve rotation sensor 310Y occurs because, each time the developing sleeve 21*a* rotates for one period, the shielding member 311 comes between the light emitting element and the light receiving element of the transmission photosensor 312 and the light receiving element does not receive the light. The timing of a significant decrease of the output voltage is a timing when the developing sleeve 21*a* is brought to the predetermined position of rotation. Hereinafter, the timing is referred to as a "reference attitude timing".

The above-described periodic image density nonuniformity is also generated due to reasons other than the image density nonuniformity generated by the development gap caused by the shaft reaction forces F1 and F2, eccentricity of the developing sleeve 21*a*, and distortion of the outer diameter. For example, when the photoconductor shaft 3*a* of the photoconductor 3 becomes eccentric, gap variations in a variation curve having a sine curve shape occur per one rotation of the photoconductor 3 due to the eccentricity of the photoconductor shaft 3*a*. Due to the gap variations, field intensity variation having a variation curve of the sine curve shape is generated by one rotation of the photoconductor 3 in a development electric field that is formed between the photoconductor 3 and the developing roller 21. Due to the field intensity variation, the image density nonuniformity that forms the variation curve of the sine curve shape is generated by one rotation of the photoconductor 3. Further, the photoconductor 3 has at least distortion in the outer shape of the surface thereof. The image density nonuniformity due to a periodic gap variation having a characteristics to form the same pattern according to the distortion is generated at one period of the photoconductor 3.

Specifically, image density nonuniformity at a rotation period of the developing sleeve 21*a* due to eccentricity of the developing sleeve 21*a* having a diameter smaller than the photoconductor 3 and distortion of the outer diameter of the developing sleeve 21*a* occurs at a relatively short period, and therefore such image density nonuniformity stands out. Further, among the periodic image density nonuniformity, image density nonuniformity generated at the rotation period of the developing sleeve 21*a* and image density nonuniformity generated at the rotation period of the photoconductor 3 are generated due to uneven rotations of the developing sleeve 21*a* and uneven rotations of the photoconductor 3.

In order to address this inconvenience, the controller 300 performs an output change processing for yellow, magenta, cyan, and black toner images, respectively, during a print job, as follows. That is, the controller 300 stores output pattern data of the developing bias in a nonvolatile memory to generate the variations in intensity of the development electric field that can cancel out the image density nonuniformity generated at the rotation period of the photoconductor 3 for each of yellow, magenta, cyan, and black toner images. The controller 300 also stores development variation pattern data in the nonvolatile memory to generate the variations in intensity of the development electric field that can cancel out the image density nonuniformity that is generated at the rotation period of the developing sleeve 21*a*. Hereinafter, the first development variation pattern data is referred to as development variation pattern data for the period of the photoconductor. Similarly, the second development variation pattern data is referred to as development variation pattern data for the period of the developing sleeve.

The pattern data of development variations at individual rotation periods of the four photoconductors 3Y, 3M, 3C, and 3K are pattern data for one rotation period of each of the photoconductors 3Y, 3M, 3C, and 3K and pattern data based on respective reference attitude timings of the photoconductors 3Y, 3M, 3C, and 3K. The pattern data of development variations are to change the output values of the developing bias from the development power supplies 301Y, 301M, 301C, and 301K based on respective developing bias reference values. For example, in a case in which the pattern data with a data table method is employed, a group of data indicating output difference of the developing bias at predetermined time intervals within a period of one period from the reference attitude timing. The top data of the group of data indicates the output difference of the developing bias at the reference attitude timing. The second, third, fourth, and nth data indicate respective output differences of the developing bias at the predetermined time intervals after the top data. The output pattern including a group of data of 0, −5, −7, −9, and −n indicates the output difference of the developing bias at the predetermined time intervals from the reference attitude timing to be 0V, −5V, −7V, −9V, and −nV. To restrain the image density nonuniformity generated at the rotation period of the photoconductors 3Y, 3M, 3C, and 3K, the developing bias having a value superimposing these values to the developing bias reference values are output from the development power supplies 301Y, 301M, 301C, and 301K, respectively. However, in the image forming apparatus 1000, the image density nonuniformity generated at the rotation period of the developing sleeve is also restrained. Therefore, the output difference of the developing bias to restrain the image density nonuniformity generated at the rotation period of the photoconductors 3Y, 3M, 3C, and 3K and the output difference of the developing bias to restrain the image density nonuniformity generated at the rotation period of the developing sleeve are superimposed on each other.

It is to be noted that, in order to make image density stable for a long period of time regardless of environmental change, the developing bias reference value is determined by a process control operation performed at a predetermined timing. The process control operation forms toner images for detecting respective amounts of yellow, magenta, cyan, and black toners. Hereinafter, these toner images are referred to as "toner amount detection images". The toner amount detection images includes multiple different toner patches having different toner adhesion amounts from each other. Then, the toner amount detection images are transferred onto the surface of the intermediate transfer belt 61 without overlaying each other. Then, the optical sensor unit 150 detects the toner adhesion amount of each of the toner amount detection images on the multiple toner patches. Then, based on the detection results, the developing bias reference values and the charging bias reference values (and optical writing intensity) to achieve respective target toner adhesion amounts are determined.

The pattern data of development variations at individual rotation periods of the four developing sleeves 21*a* of the developing rollers 21 of the developing devices 4Y, 4M, 4C, and 4K are pattern data for one rotation period of each pattern data of development variations are pattern data for one rotation period of the respective developing sleeves 21*a* and pattern data based on the reference attitude timings of the respective developing sleeves 21*a*. The pattern data of development variations are to change the output values of the developing bias from the development power supplies 301Y, 301M, 301C, and 301K based on respective developing bias reference values determined by the process control operation that functions as a reference value determining operation. In a case in which the pattern data with the data table method is employed, the top data of a group of data indicates output difference of the developing bias at the reference attitude timing. The second, third, fourth, and nth data indicate respective output differences of the developing bias at the predetermined time intervals after the top data. The predetermined time intervals are same as the predetermined time intervals that are reflected by the group of data of the pattern data of development variations at the rotation periods of the photoconductors 3Y, 3M, 3C, and 3K.

In image formation, the controller 300 reads data from the pattern data of development variations at the rotation periods of the photoconductors 3Y, 3M, 3C, and 3K at predetermined intervals of time. At the same time, the reading of data from the pattern data of development variations at the rotation period of the developing sleeves 21*a* of the developing rollers 21 of the developing devices 4Y, 4M, 4C, and 4K is also performed at the same time intervals. For the reading of the data from the pattern data of development variations at the rotation periods of the photoconductors 3Y, 3M, 3C, and 3K and the data from the pattern data of development variations at the rotation period of the developing sleeves 21*a*, when the reference attitude timing does not arrive even after completion of the reading of the last line of the group of data, a reading value is set to the same value of the last data until the reference attitude timing arrives. By contrast, when the reference attitude timing arrives before the last line of the data is read, a data reading position is returned to the first data. It is to be noted that, regarding the reading of data from the pattern data of development variations at the rotation period of the photoconductors 3Y, 3M, 3C, and 3K, each timing at which each reference attitude timing signal is sent from the photoconductor rotation sensors 330Y, 330M, 330C, and 330K is set as a reference attitude timing. Further, regarding the reading of data from the pattern data of development variations at the rotation period of the developing sleeves 21*a*, each timing at which each reference attitude timing signal is sent from the sleeve rotation sensors 310Y, 310M, 310C, and 310K is set as a reference attitude timing.

In the process of reading these data for yellow, magenta, cyan, and black toner images, respective superimposed values are obtained by adding data read from the pattern data of development variations at the rotation period of the photoconductors 3Y, 3M, 3C, and 3K and data read from the pattern data of development variations at the rotation period of the developing sleeves 21*a*. For example, the data read from the pattern data of development variations at the rotation period of the photoconductors 3Y, 3M, 3C, and 3K is −5V and the data read from the pattern data of development variations at the rotation period of the developing sleeves 21*a* is 2V, the value of −5V and the value of 2V are added to obtain a superimposed value of −3V. Then, when the developing bias reference value is, for example, −550V, a value of −553V that is obtained by adding the superimposed value of −3V to the developing bias reference value of −550V is output from a development power supply. The above-described operation is performed at the predetermined time intervals of each of the yellow, magenta, cyan, and black toner images.

Accordingly, respective electric field intensity variations are generated in the respective development electric fields formed between the photoconductors 3Y, 3M, 3C, and 3K and the developing sleeves 21*a* of the developing devices 4Y, 4M, 4C, and 4K, respectively, so that electric field intensity variations to which the following two electric field intensity variations can be canceled out. That is, the two electric field intensity variations are the electric field intensity variation caused by the gap variation generated at the rotation period of the photoconductors 3Y, 3M, 3C, and 3K due to eccentricity of the photoconductors 3Y, 3M, 3C, and 3K and distortion of the outer diameter of the photoconductors 3Y, 3M, 3C, and 3K and the electric field intensity variation generated at the rotation period of the developing sleeve 21*a* due to eccentricity of the developing sleeve 21*a*, distortion of the outer diameter of the developing sleeve 21*a*, and the shaft reaction force F1 of the developing joint 95. By so doing, regardless of the rotation attitude of the photoconductor 3 and the developing sleeve 21*a*, a substantially constant development electric field is formed between the photoconductor 3 and the developing sleeve 21*a*. Accordingly, both the image density nonuniformity generated at the rotation period of the photoconductor and the image density nonuniformity generated at the rotation period of the developing sleeve can be restrained.

The pattern data of development variations at individual rotation periods of the four photoconductors 3Y, 3M, 3C, and 3K and the pattern data of development variations at the rotation period of the developing sleeves 21*a* are created by performing a data creation process at predetermined timings. The predetermined timings include a timing prior to the first print job after factory shipping (hereinafter, referred to as an "initial start timing") and a timing at which replacement of any of the image forming units 2Y, 2M, 2C, and 2K is detected (hereinafter, referred to as a "replacement detection timing"). At the initial start timing, the pattern data of development variations at the rotation period of the photoconductors 3Y, 3M, 3C, and 3K are created for the yellow, magenta, cyan, and black toner images, respectively. Similarly, the pattern data of development variations at the rotation period of the developing sleeves 21*a* are also created for the yellow, magenta, cyan, and black toner images, respectively. By contrast, at the replacement detection timing, the pattern data of development variations at the rotation period of the photoconductors 3Y, 3M, 3C, and 3K and the pattern data of development variations at the rotation period of the developing sleeves 21*a* are created for an image forming unit whose replacement has been detected out of the image forming units 2Y, 2M, 2C, and 2K are created. In order to create the above-described pattern data, respective unit detachment and attachment sensors are provided to detect replacement of the image forming units 2Y, 2M, 2C, and 2K individually.

Figure 15:
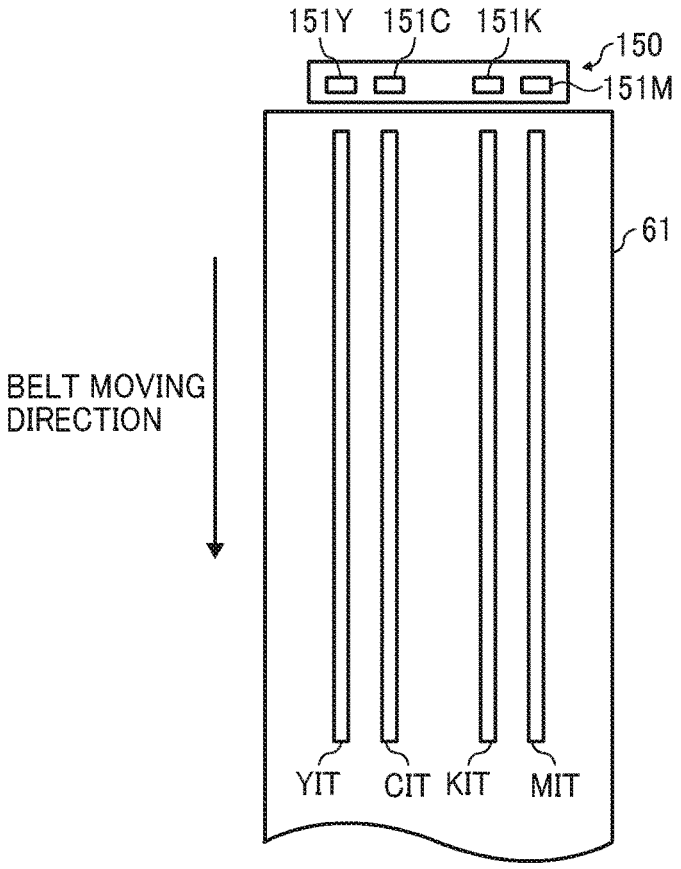
FIG. 15 is a plan view illustrating solid toner images for image density nonuniformity detection transferred onto an intermediate transfer belt.

In a data creating operation at the initial start timing, a solid yellow toner image for image density nonuniformity detection YIT is formed on the surface of the photoconductor 3Y. Further, a solid cyan toner image for image density nonuniformity detection CIT is formed on the surface of the photoconductor 3C, a solid magenta toner image for image density nonuniformity detection MIT is formed on the surface of the photoconductor 3M, and a solid black toner image for image density nonuniformity detection KIT is formed on the surface of the photoconductor 3K. Then, these solid toner images for image density nonuniformity detection are transferred onto the intermediate transfer belt 61 as primarily transfer, as illustrated in FIG. 15. In FIG. 15, the solid yellow toner image for image density nonuniformity detection YIT is prepared to detect the image density nonuniformity generated at the rotation period of the photoconductor 3Y, and therefore is formed in a length longer than a circumferential length of the photoconductor 3Y in a belt moving direction. Similarly, the solid cyan toner image for image density nonuniformity detection CIT is prepared to detect the image density nonuniformity generated at the rotation period of the photoconductor 3C, and therefore is formed in a length longer than a circumferential length of the photoconductor 3C in the belt moving direction. The solid magenta toner image for image density nonuniformity detection MIT is prepared to detect the image density nonuniformity generated at the rotation period of the photoconductor 3M, and therefore is formed in a length longer than a circumferential length of the photoconductor 3M in the belt moving direction. The solid black toner image for image density nonuniformity detection KIT is prepared to detect the image density nonuniformity generated at the rotation period of the photoconductor 3K, and therefore is formed in a length longer than a circumferential length of the photoconductor 3K in the belt moving direction.

It is to be noted that FIG. 15 illustrates an example of the configuration in which the four solid toner images for image density nonuniformity detection YIT, CIT, MIT, and KIT are aligned straight in a belt width direction, for convenience. However, the actual image forming positions of the four solid toner images for image density nonuniformity detection YIT, CIT, MIT, and KIT on the intermediate transfer belt 61 are likely to shift by the same length as the circumferential surface of the photoconductors 3Y, 3C, 3M, and 3K at most in the belt moving direction. The shift is generated because the image formation of the four solid toner images for image density nonuniformity detection YIT, CIT, MIT, and KIT is started such that the leading positions of the four solid toner images for image density nonuniformity detection YIT, CIT, MIT, and KIT match the reference positions in the circumferential direction of the photoconductors 3Y, 3C, 3M, and 3K (i.e., the positions of the surfaces of the photoconductors 3Y, 3C, 3M, and 3K that enter the development region at respective reference attitude timings). That is, the solid toner images for image density nonuniformity detection YIT, CIT, MIT, and KIT are formed so as to match the leading ends of the photoconductors 3Y, 3C, 3M, and 3K with the reference positions in the circumferential direction of the photoconductors 3Y, 3C, 3M, and 3K.

Instead of the solid toner images, halftone toner images may be formed as toner images for image density nonuniformity detection. For example, a halftone toner image having a 70% dot area ratio can be applied.

Further, the controller 300 performs the construction processing together with the process control operation as a set of operations. Specifically, the process control operation is performed immediately before the construction processing, so that respective developing bias reference values of yellow, magenta, cyan, and black toner colors are determined. Then, in the construction processing immediately after the process control operation, the solid toner images for image density nonuniformity detection YIT, CIT, MIT, and KIT are developed under the conditions of the developing bias reference values that have been determined in the process control operation. Therefore, the solid toner images for image density nonuniformity detection YIT, CIT, MIT, and KIT are formed to have respective target toner adhesion amounts, theoretically. However, image density nonuniformity appears due to the development gap, actually.

A time lag from the start of image formation of the solid toner images for image density nonuniformity detection YIT, CIT, MIT, and KIT (from the start of writing of electrostatic latent images) to the entrance of the leading ends of the solid toner images for image density nonuniformity detection YIT, CIT, MIT, and KIT to the respective detection position by the reflection photosensors of the optical sensor unit 150 are different in colors. However, the same color maintains a constant value over age. Hereinafter, the constant value over age is referred to as a writing-detecting time lag.

The controller 300 previously stores the writing-detecting time lag of each of the toner images in the nonvolatile memory. Then, after image formation of the solid toner images for image density nonuniformity detection YIT, CIT, MIT, and KIT is started and at a point at which the writing-detecting time lag has elapsed, samplings of outputs from reflection photosensors 151Y, 151M, 151C, and 151K are started. The samplings are repeated at the predetermined intervals over one rotation period of the photoconductors 3Y, 3M, 3C, and 3K. The predetermined time intervals are the same time values as the time intervals of reading each data in the output pattern data used for output change processing. The controller 300 creates a graph of image density nonuniformity that represents a relation of a toner adhesion amount (the image density) and a time (or the photoconductor surface position) based on the sampling data of each color toner images and extracts two patterns of solid image density nonuniformity from the graph of image density nonuniformity. The first pattern is a pattern of solid image density nonuniformity generated at the rotation period of the photoconductor 3. The second pattern is a pattern of solid image density nonuniformity generated at the rotation period of the developing sleeve 21*a*.

After having extracted the pattern of solid toner image density nonuniformity generated at the rotation period of the photoconductors 3Y, 3M, 3C, and 3K based on the above-described sampling data, the controller 300 calculates an average toner adhesion amount value (an average image density value). The average toner adhesion amount value is a value substantially reflecting an average value of variations in the development gap for one rotation period of the photoconductor. The controller 300 creates periodic output pattern data of the photoconductor based on the average toner adhesion amount value so as to cancel out the pattern of solid toner image density nonuniformity at the rotation period of the photoconductor. Specifically, the controller 300 calculates a bias output difference individually corresponding to multiple toner adhesion amounts included in the solid image density pattern. The bias output difference is based on the average toner adhesion amount value. The controller 300 calculates the bias output difference corresponding to toner adhesion amount data having the same value as the average toner adhesion amount value as zero (0).

Further, the controller 300 calculates a bias output difference corresponding to the toner adhesion amount data greater than the average toner adhesion amount value as a positive polarity value according to the difference between the toner adhesion amount and the average toner adhesion amount value. As being the bias output difference of the positive polarity, the data changes the developing bias of a negative polarity to a value smaller than the developing bias reference value (i.e., a value having a small absolute value).

Further, the controller 300 calculates a bias output difference corresponding to the toner adhesion amount data smaller than the average toner adhesion amount value as a negative polarity value according to the difference between the toner adhesion amount and the average toner adhesion amount value. As being the bias output difference of the negative polarity, the data changes the developing bias of the negative polarity to a value greater than the developing bias reference value (i.e., a value having a large absolute value).

Thus, the controller 300 calculates to obtain the bias output differences corresponding to the individual toner adhesion amounts, and creates data aligned in order as periodic output pattern data of the photoconductor that functions as output pattern data.

After having extracted the pattern of solid toner image density nonuniformity generated at the rotation period of the developing sleeves based on the above-described sampling data, the controller 300 calculates an average toner adhesion amount value (the average image density value). The average toner adhesion amount value is a value substantially reflecting an average value of variations in the development gap for one rotation period of the developing sleeve. The controller 300 creates periodic output pattern data of the developing sleeve based on the average toner adhesion amount value so as to cancel out the pattern of toner image density nonuniformity generated at the rotation period of the developing sleeve. The details of creation of the periodic output pattern data of the developing sleeve is same as a method of creating the periodic output pattern data of the photoconductor to cancel out the pattern of toner image density nonuniformity generated at the rotation period of the photoconductor.

Figure 16:
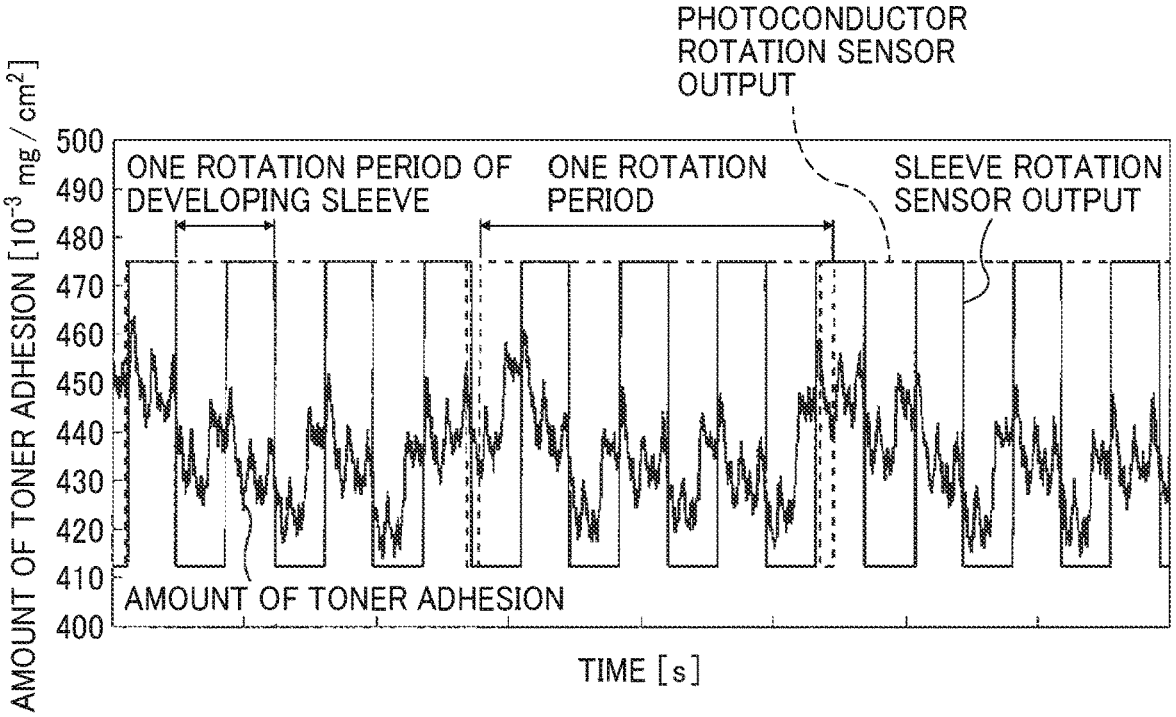
FIG. 16 is a graph illustrating a relation of periodic variations in amount of toner adhered to the solid toner image for image density nonuniformity detection, outputs of the sleeve rotation sensor, and outputs of the photoconductor rotation sensor.

FIG. 16 is a graph illustrating a relation of periodic variations in the toner adhesion amount of the solid toner images for image density nonuniformity detection, the output values of the sleeve rotation sensors, and the output values of the photoconductor rotation sensors. The vertical axis of the graph indicates the toner adhesion amount of $10^{-3}$ mg/cm$^2$. This value is obtained by converting the output voltage from the reflection photosensor 151 of the optical sensor unit 150 to the toner adhesion amount based on a predetermined conversion equation. As can be seen from the graph, periodic image density nonuniformity is generated on the solid toner images for image density nonuniformity detection in the belt moving direction of the intermediate transfer belt 61.

Figure 17:
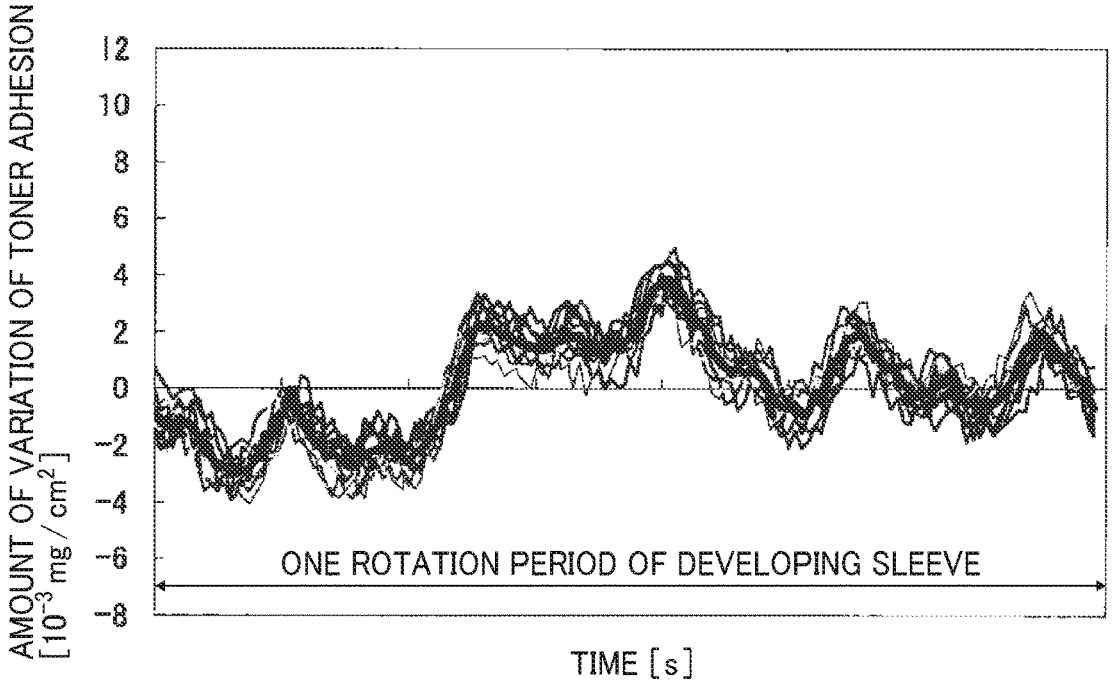
FIG. 17 is a graph illustrating average waveforms.

In creation of pattern data of development variations at the rotation period of the developing sleeve, a component of periodic variations different from the rotation period of the developing sleeve is removed. To do so, data of variations in toner adhesion amount with time is cut at each rotation period of the developing sleeve to perform an averaging process. Specifically, since a length of the solid toner image for image density nonuniformity detection is more than 10 times greater than the circumferential length of the developing sleeve, the data of variations in toner adhesion amount with time is obtained over 10 times as the rotation period of the developing sleeve. A variation waveform based on the data of variations in toner adhesion amount with time is cut at each period of the developing sleeve with the reference attitude timing of the developing sleeve being as the leading timing. After having obtained ten (10) cut waveforms, the cut waveforms are overlaid under the conditions in which the reference attitude timing of the developing sleeve is synchronized, as illustrated in FIG. 17, so as to perform the averaging process to analyze an average waveform. The average waveform obtained by averaging the ten waveforms is indicated by a bold line in FIG. 17. Even though each of the cut waveforms is not unstable by including a periodic variation component different from the sleeve rotation period, the unstable cut waveforms reduce the average waveform. It is to be noted that, in the image forming apparatus 1000, the averaging process is performed with ten cut waveforms. However, as long as a variation component for the rotation period of the developing sleeve can be extracted, any other method may be employed.

Figure 18:
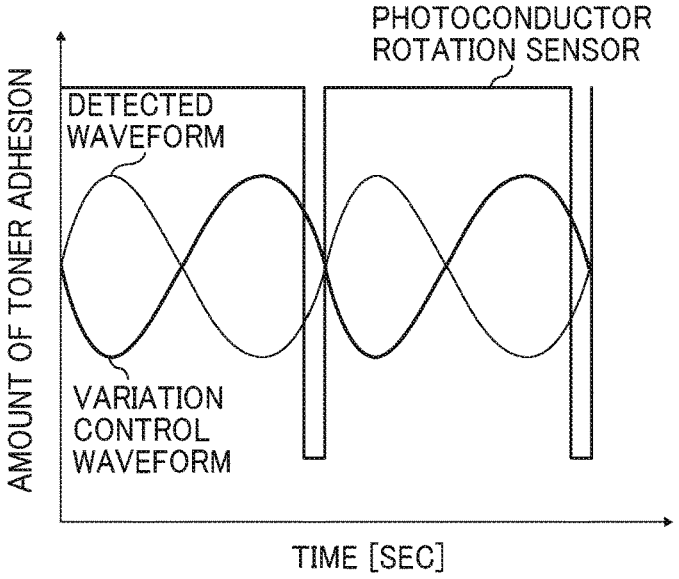
FIG. 18 is a graph illustrating principles of algorithm used when patter data of development variations is created.

In the image forming apparatus 1000, similar to the data of development variations at the rotation period of the developing sleeve, the averaging process is performed for data of development variations at the rotation period of the photoconductor with waveforms cut at each period of the photoconductor, and the data is created based on the results of the averaging process. In creation of data of development variations based on the average waveforms, the following algorithm is used to convert the toner adhesion amount to a developing bias variation amount. That is, as illustrated in FIG. 18, the algorithm can generate variations in the developing bias to provide a variation control waveform that forms a reverse phase to the detected waveform of the toner adhesion amount.

Figure 19:
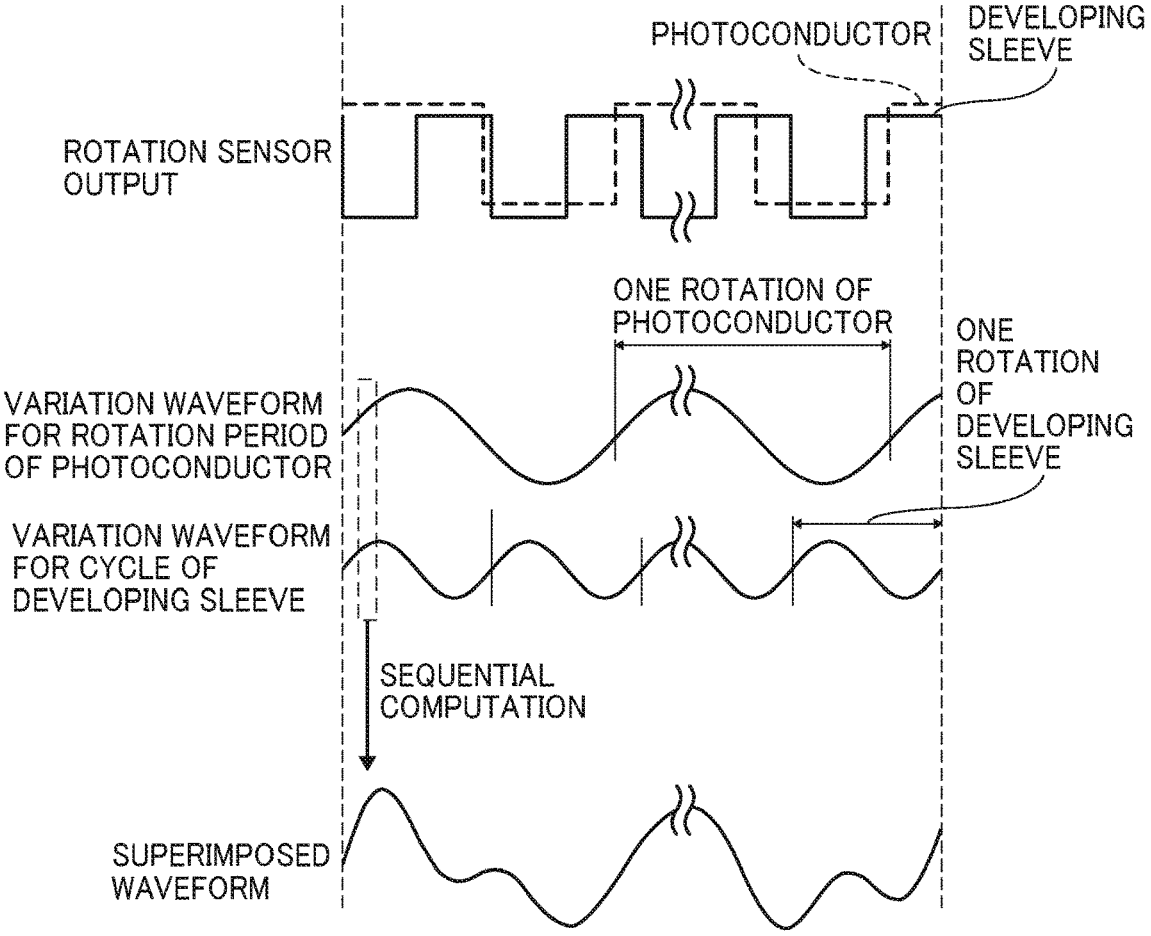
FIG. 19 is a timing chart illustrating output timings during image formation.

As described above, the output values of the developing bias from the development power supplies 301Y, 301M, 301C, and 301K for each color toner images are changed by using the periodic output pattern data of the photoconductor and the periodic output pattern data of the developing sleeve constructed in the construction processing. Specifically, as illustrated in FIG. 19, the developing bias is varied periodically according to the superimposed waveform obtained by superimposing the developing bias variation waveform by the pattern data of development variations at the rotation period of the photoconductors 3Y, 3M, 3C, and 3K and the developing bias variation waveform by the pattern data of development variations at the rotation period of the developing sleeves 21*a* to each other. Consequently, the solid image density nonuniformity generated at the rotation period of the photoconductor and the solid image density nonuniformity generated at the rotation period of the developing sleeve can be restrained.

In an image including a solid part and a halftone part, the image density of the solid part is significantly susceptible to a developing potential that is a difference between a developing bias Vb and a latent image potential VI that is a potential of an electrostatic latent image. By contrast, the image density of the halftone part is significantly susceptible to a background potential that is a difference between a photoconductor background potential Vd and the developing bias Vb when compared with the developing potential. These differences occur based on the following reasons. Specifically, each dot is overlaid on an adjacent dot or adjacent dots on a peripheral portion in the solid part. That is, there are no isolated dots. By contrast, there are isolated dots or groups of small dots in the halftone part. These isolated dots or groups of small dots are significantly susceptible to an edge effect more than the solid part. Therefore, the halftone part has a greater adhesion force on the photoconductor than the solid part under the condition of the background potential that is same as the solid part, and is less susceptible to the gap variation.

Further, the halftone part includes the toner adhesion amount per unit area greater than the solid part. The toner adhesion variation amount due to gap variation in the halftone part are smaller than the toner adhesion variation amount in the solid part. When the developing bias Vb is changed in the superimposed output pattern created based on the image density nonuniformity pattern of the toner image for image density nonuniformity detection including the solid toner image, the image density nonuniformity in the solid part can be restrained while the image density nonuniformity in the halftone part is overcorrected. Consequently, the image density nonuniformity is generated in the halftone part due to the overcorrection.

The edge effect is significantly susceptible to the background potential. Therefore, by adjusting the background potential, the above-described overcorrection can be adjusted. By changing the background potential Vd due to change of the charging bias, the background potential is changed. Even if the background potential Vd is changed as described above, the developing potential can maintain approximately to a constant value. For example, the background potential Vd is changed to −1000V or −1200V accordingly under the condition in which the background potential Vd is −1100V, the developing bias Vb is −700V, and the latent image potential VI is −50V. Even if the background potential Vd is changed as described above, when a latent image writing intensity is set to a value that can obtain a saturation exposure potential of approximately −50V, the latent image potential VI can be maintained approximately to −50 regardless of the background potential Vd. Therefore, even if the background potential is changed depending on the change of the background potential Vd, the developing bias Vb can be maintained to a constant value, and therefore the image density in the solid part is not adversely affected.

Accordingly, the controller 300 creates a photoconductor period charging variation pattern and a sleeve period charging variation pattern in addition to a photoconductor period developing variation pattern and a sleeve period developing variation pattern for respective color toner images in the above-described construction processing. Specifically, when the developing variation pattern is created, a yellow toner image for halftone image density nonuniformity detection including a yellow halftone toner image is formed on the photoconductor 3Y. Similarly, a magenta toner image for halftone image density nonuniformity detection including a magenta halftone toner image is formed on the photoconductor 3M, a cyan toner image for halftone image density nonuniformity detection including a cyan halftone toner image is formed on the photoconductor 3C, and a black toner image for halftone image density nonuniformity detection including a black halftone toner image is formed on the photoconductor 3K. When forming the toner images for image density nonuniformity detection, the developing bias Vb is changed based on the developing bias reference value, the photoconductor period developing variation pattern, the reference photoconductor attitude timing, the sleeve period developing variation pattern, and a reference developing sleeve attitude timing. In the conditions, the image density nonuniformity at the rotation period of the photoconductor and at the rotation period of the developing sleeve can be restrained. However, since the above-described four toner images for image density nonuniformity detection include respective halftone toner images, the image density nonuniformity is generated due to overcorrection of the developing bias Vb. The controller 300 detects the image density nonuniformity by performing sampling of the output values of the four reflection photosensors 151Y, 151M, 151C, and 151K of the optical sensor unit 150 at predetermined intervals of time for one of more periods of the photoconductor 3.

Thereafter, the controller 300 extracts image density nonuniformity patterns generated at the rotation period of the photoconductor based on the sampling data obtained for respective toner color images. Then, the controller 300 calculates the average toner adhesion amount (the average image density value) of the toner image for image density nonuniformity detection based on the image density nonuniformity pattern. Then, the controller 300 creates charging variation pattern data based on the above-described average toner adhesion amount. The charging variation pattern data corresponds to an output variation pattern of periodic image density nonuniformity generated at the rotation period of the photoconductor of the charging bias to cancel out the pattern of image density nonuniformity generated at the rotation period of the photoconductor. Specifically, the controller 300 calculates a bias output difference individually corresponding to multiple toner adhesion amount data included in the pattern of image density nonuniformity. The bias output difference is based on the average toner adhesion amount value. The controller 300 calculates the bias output difference corresponding to the toner adhesion amount data having the same value as the average toner adhesion amount value as zero (0). Further, the controller 300 calculates a bias output difference corresponding to the toner adhesion amount data greater than the average toner adhesion amount value as a positive polarity value according to the difference between the toner adhesion amount and the average toner adhesion amount value. As being the bias output difference of the positive polarity, the data changes the developing bias of the negative polarity to a value smaller than the developing bias reference value (i.e., a value having a small absolute value). Further, the controller 300 calculates a bias output difference corresponding to the toner adhesion amount data smaller than the average toner adhesion amount value as a negative polarity value according to the difference between the toner adhesion amount and the average toner adhesion amount value. As being the bias output difference of the negative polarity, the data changes the developing bias of the negative polarity to a value greater than the developing bias reference value (i.e., a value having a large absolute value).

Thus, the controller 300 obtains the bias output differences corresponding to the individual toner adhesion amounts, and creates data aligned in order as photoconductor period charging variation pattern data.

After having extracted the pattern of the image density nonuniformity pattern generated at the rotation period of the developing sleeves based on the above-described sampling data for the respective color toner images, the controller 300 calculates an average toner adhesion amount value (the average image density value). The controller 300 creates developing sleeve period charging variation pattern data that is the periodic output pattern data of the developing sleeve for the charging bias, based on the average toner adhesion amount value, so as to cancel out the image density nonuniformity pattern at the rotation period of the developing sleeve. The details of creation of the developing sleeve period charging variation pattern data is same as the method of creating the photoconductor period charging variation pattern data.

Thus, after creating the charging variation pattern data, the orders of individual data included in the photoconductor period charging variation pattern data are shifted by respective predetermined numbers. Specifically, head data in the photoconductor period development variation pattern data corresponds to a position, out of the entire circumferential surface of the photoconductor, to enter the development region when the photoconductor is brought to a reference rotation attitude. The position is not charged in the development region but is charged in a contact region where the charging roller 5*a* of the charging device 5 (i.e., the charging devices 5Y, 5M, 5C, and 5K) contacts the photoconductor 3 (i.e., the photoconductors 3Y, 3M, 3C, and 3K). Since there is a time lag for the position to move from the contact region to the development region, the positions of the individual data are shifted by the numbers corresponding to the time lag. For example, in a case in which the pattern data includes 250 data, the positions of the 1st data to the 230th data are shifted by the number of 20 data and the positions of the 231th data to the 250th data are shifted to allocate as the 1st data to the 20th data. Similar to the photoconductor period charging variation pattern data, the positions of the individual data of the developing sleeve period charging variation pattern data are shifted by the predetermined numbers.

When forming toner images based on instructions by a user, the output values of the developing bias Vb from the development power supply are changed for the respective color toner images based on the photoconductor period development variation pattern data and the development sleeve period development variation pattern data created by the construction processing. Specifically, superimposed output pattern data (superimposed waveform reproduction data) is created based on the photoconductor period development variation pattern data, the reference photoconductor attitude timing, the development sleeve period development variation pattern data, and the reference developing sleeve attitude timing. The output values of the developing bias Vb are changed based on the superimposed output pattern data and the developing bias reference value. Consequently, the image density nonuniformity in the solid part generated at the rotation period of the photoconductor and at the rotation period of the developing sleeve can be restrained.

As described above, concurrently with the variations of the developing bias, the output values of the charging bias from the charging power supply are changed based on the photoconductor period charging variation pattern data and the developing sleeve period charging variation pattern data created in the construction processing. Specifically, a superimposed output pattern data is created based on the photoconductor period charging variation pattern data, the reference photoconductor attitude timing, the development sleeve period charging variation pattern data, and the reference developing sleeve attitude timing. The output values of the charging bias from the charging power supply is changed based on the superimposed output pattern data and the charging bias reference value that functions as a reference value that has been determined in the process control operation. Consequently, the image density nonuniformity in the halftone part generated at the rotation period of the photoconductor and at the rotation period of the developing sleeve due to the overcorrection of the developing bias Vb can be restrained.

Next, a description is given of corrections of image density nonuniformity in the period having an integral multiple of the rotation period of the developing sleeve.

Out of the periodic image density nonuniformity, the image density nonuniformity (i.e., image density nonuniformity of the frequency that is three times or smaller than the number of rotations of the developing sleeve) that is three times or smaller than the rotation period of the developing sleeve (i.e., a tertiary component of the rotation period of the developing sleeve) is corrected by periodically varying the developing bias and the charging bias. By contrast, the image density nonuniformity (i.e., image density nonuniformity of the frequency that is four times or greater than the number of rotations of the developing sleeve) that is four times or greater than the rotation period of the developing sleeve (i.e., a quaternary component of the rotation period of the developing sleeve) cannot be corrected by periodically varying the developing bias and the charging bias, and therefore is corrected preferably by periodically varying the writing light amount of the optical writing unit.

The periodic image density nonuniformity that is four times or greater than the rotation period of the developing sleeve (i.e., the quaternary component of the rotation period of the developing sleeve) cannot be corrected preferably with the periodic variations of the developing bias and the charging bias due to the following reasons. The development region on which an electrostatic latent image formed on the surface of the photoconductor includes a predetermined width in the moving direction of the surface of the photoconductor. During the period of time from when the electrostatic latent image enters the development region to when the electrostatic latent image exits the development region, even if the output value of the developing bias is changed, it is significantly difficult to change the image density of the electrostatic latent image following the change of the output value of the developing bias. An average bias value in the above-described period of time is significantly susceptible to the image density of the electrostatic latent image, and therefore an instantaneous bias change does not apply large impact on the image density. In a case in which the width of the photoconductor in the development region in the moving direction of the surface of the photoconductor becomes narrower in order to avoid this phenomenon, a sufficient developing ability cannot be obtained. Therefore, the frequency of the periodic variation component of the image density that can be restrained due to the variations of the developing bias has an upper limit. Due to these reasons, in the present embodiment, the writing light amount of the optical writing unit is periodically varied to correct the periodic image density nonuniformity that is four times or greater than the rotation period of the developing sleeve.

For the periodic image density nonuniformity that is two to three times as the rotation period of the developing sleeve, an average waveform is reproduced by overlaying multiple sine waves that vary in a period of two to three times as the rotation period of the developing sleeve. The controller 300 creates the developing variation pattern data that is two to three times as the rotation period of the developing sleeve based on the reproduced average waveform.

Detailed procedures of the method of data creation are described as follows.

First, the controller 300 performs the frequency analysis to the average waveform. The frequency analysis is performed based on a fast Fourier transform (FFT) or a quadrature detection. In the present embodiment, the frequency analysis is performed based on the quadrature detection.

FIG. 17 is a graph illustrating average waveforms. The average waveforms in the graph of FIG. 17 can be expressed by overlaying the sine waves that periodically vary at the frequency having an integral multiple of the rotation period of the developing sleeve, as expressed in the following formula. It is to be noted that "x" represents an upper limit of a variable frequency of the sine wave.

$$f(t)=A_1\times\sin(\omega t+\theta_1)+A_2\times\sin(2\times\omega t+\theta_2)+A_3\times\sin(3\times\omega t+\theta_3)+\ldots+A_x\times\sin(x\times\omega t+\theta_x).$$

This formula can be changed to the following formula:

$$f(t)=\Sigma A_1\times\sin(i\times\omega t+\theta_i),$$

where "i" is any natural number of 1 through x.

The parameters in the formulas are as follows:

f(t): average waveform of a cut waveform of variation amount of toner adhesion [$10^{-3}$ mg/cm$^2$];

Ai: amplitude of a sine wave [$10^{-3}$ mg/cm$^2$];

ω: angular velocity of a developing sleeve [rad/s];

θi: phase of the sine wave [rad/s]; and t: time [s].

In the present embodiment, the amplitude of a sine wave (A1) and a phase of the sine wave (θi) are calculated by the quadrature detection, so that the components of the image density nonuniformity of each frequency are calculated. Then, a reproduced waveform to create the development sleeve period development variation pattern data is created based on the following formula:

$$f_{1/2}(t)=\Sigma Ai\times\sin(i\times\omega t+\theta_i),$$

where "i" is 1 through 3.

When "i" is 1, one rotation period of the developing sleeve is indicated.

The charging variation pattern data is created similar to the creation of the developing variation pattern data described above. Further, the periodic variation component that is two to three times as the rotation period of the photoconductor is also created similar to the creation of the developing variation pattern data described above.

Next, a description is given of corrections of periodic image density nonuniformity of a high frequency that is four times or greater than the rotation period of the developing sleeve (i.e., the quaternary component of the rotation period of the developing sleeve). The periodic image density nonuniformity of high frequency can be grasped based on the image density nonuniformity pattern of the solid toner images for image density nonuniformity detection formed in order to create the developing variation pattern data.

The image density variation due to variations in writing light amount can be generated in a unit of dot, and therefore can be used as a useful method to cancel out the periodic variation component that is generated in the period of high frequency. The controller 300 creates the reproduced waveform to create the development sleeve period latent image variation pattern data based on the following formula:

$$f_3(t)=\Sigma Ai\times\sin(i\times\omega t+\theta_i),$$

where "i" is any natural number of 4 through 20.

Figure 20:
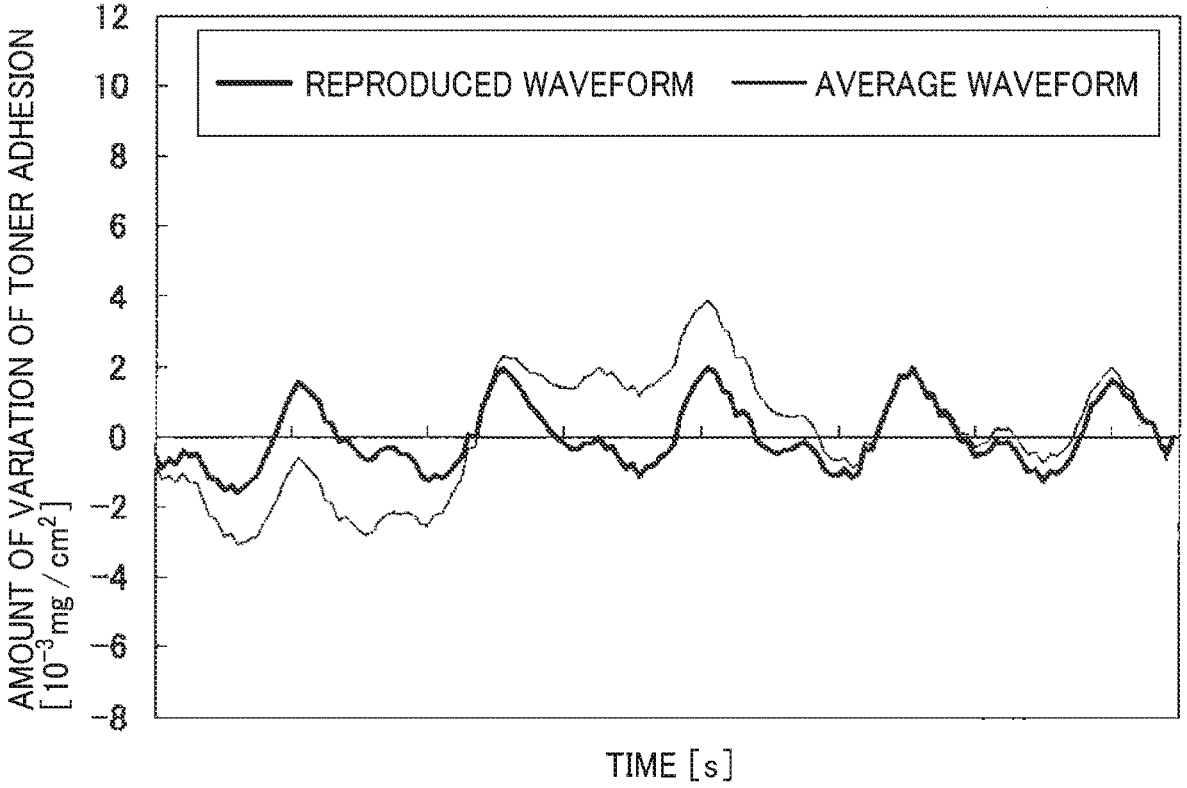
FIG. 20 is a graph illustrating average waveforms to be referred to when patter data of variations in electrostatic latent image to change a light amount of optical writing and the changes of the amount of toner adhered to the toner image in reproduced waveforms converted form reproduction.

The thus created reproduced waveform is presented in a graph of FIG. 20. Based on the reproduced waveform, the development sleeve period latent image variation pattern data is created. These data reflect the writing light amount, which is the optical writing intensity LDP (laser diode power) [%]. The data is to reduce high frequency components in a target image density by multiplying the writing light amount by a gain appropriately. Exposure intensity, which is a LD power, in this disclosure periodically changes to cancel the high frequency component that is indicated with a bold line in the graph of FIG. 16. Further, the periodic variation component that is four times or greater than the rotation period of the photoconductor is also created similarly.

When forming toner images based on instructions by a user, the following superimposed variation pattern data is created based on the photoconductor period latent image variation pattern data, the development sleeve period latent image variation pattern data, the reference photoconductor attitude timing, and the reference developing sleeve attitude timing. Specifically, the superimposed variation pattern data generates a superimposed variation waveform in which a latent image variation waveform at the rotation period of the photoconductor (a variation waveform of the writing light amount) and a latent image variation waveform at the rotation period of the developing sleeve are superimposed to each other. Consequently, the superimposed variation pattern data is sequentially sent from the controller 300 to the writing controller 303. The writing controller 303 periodically varies the writing light amount based on the superimposed variation pattern data. The above-described operation is performed individually on the yellow, magenta, cyan, and black toner images.

Consequently, the image density nonuniformity having the frequency of an integral multiple of the rotation period of the developing sleeve and the image density nonuniformity having the frequency of an integral multiple of the rotation period of the photoconductor can be corrected. Further, it is to be noted that the above-described correction of the periodic image density nonuniformity of high frequency that is four times or greater than the developing sleeve rotation period or the photoconductor rotation period is performed by periodically varying the writing light amount of the optical writing unit. However, the periodic variation component that is three times or smaller than the rotation period of the developing sleeve of the rotation period of the photoconductor can be corrected by periodically varying the writing light amount of the optical writing unit.

Figure 21:
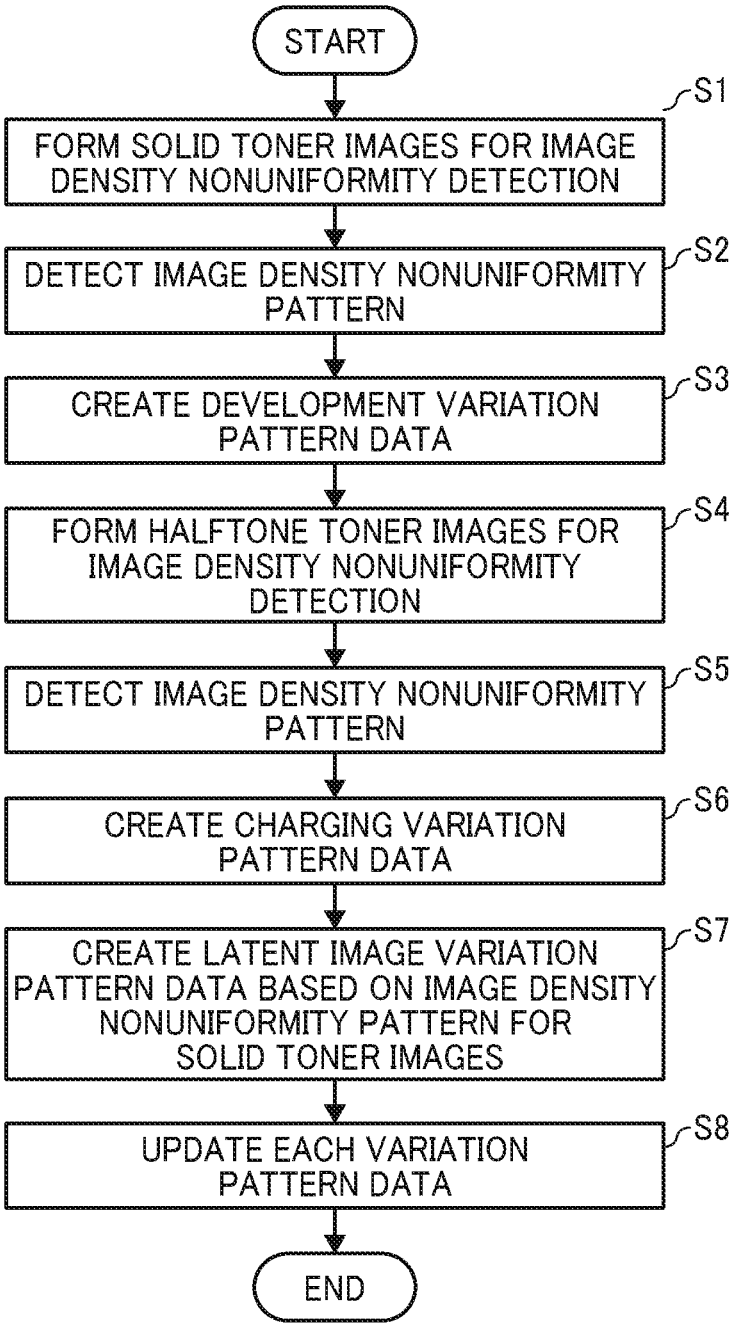
FIG. 21 is a flowchart of a process flow of building of variation pattern data.

FIG. 21 is a flowchart of a process flow of creating variation pattern data.

First, the controller 300 causes to form solid toner images for image density nonuniformity detection in step S1. At this time, the developing bias, the charging bias, and the writing light amount have respective constant values. Then, the image density nonuniformity pattern of each of the solid toner images for image density nonuniformity detection are detected, in step S2. Thereafter, in step S3, the controller 300 creates the development variation pattern data based on the image density nonuniformity pattern obtained in step S2. Thereafter, while the developing bias is periodically being varied based on the development variation pattern data, the controller 300 causes to form the halftone toner images for detecting image density nonuniformity, in step S4. Then, the image density nonuniformity pattern of each of the halftone toner images for detecting image density nonuniformity is detected, in step S5. Further, the charging variation pattern data is formed based on the above-described image density nonuniformity pattern, in step S6. Thereafter, in step S7, the controller 300 creates the latent image variation pattern data based on the image density nonuniformity pattern of the solid toner images for image density nonuniformity detection detected in step S2. Then, the development variation pattern data, the charging variation pattern data, and the latent image variation pattern data, which have been stored until a timing immediately before the start of this operation are updated to new data obtained by the operation. The above-described operation flow is performed individually on the yellow, magenta, cyan, and black toner images. The operation may performed with sequential processes with one color toner image at a time or two color toner images in parallel.

Figure 22A:
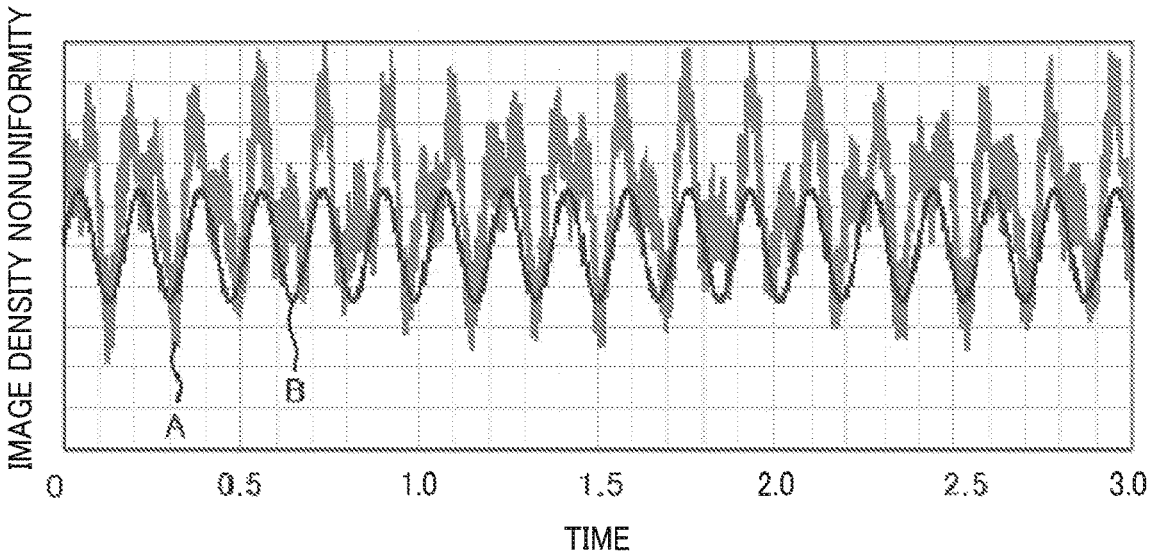
FIGS. 22A and 22B are graphs illustrating correction of density with the relation of the number of rotations of the screw joint and the number of rotations of the developing sleeve of FIG. 9.
Figure 22B:
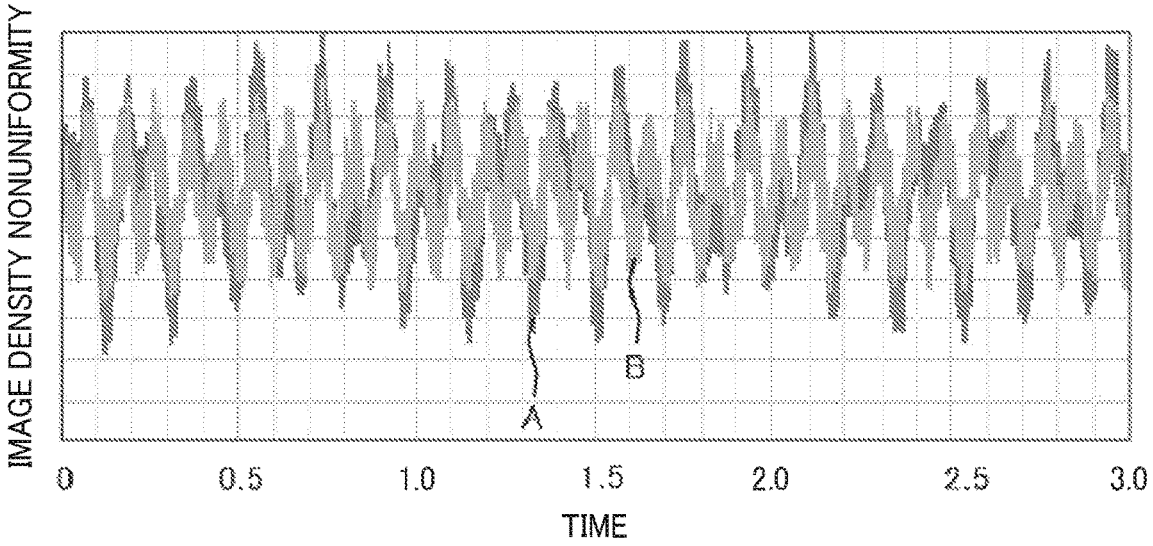
Figure 23A:
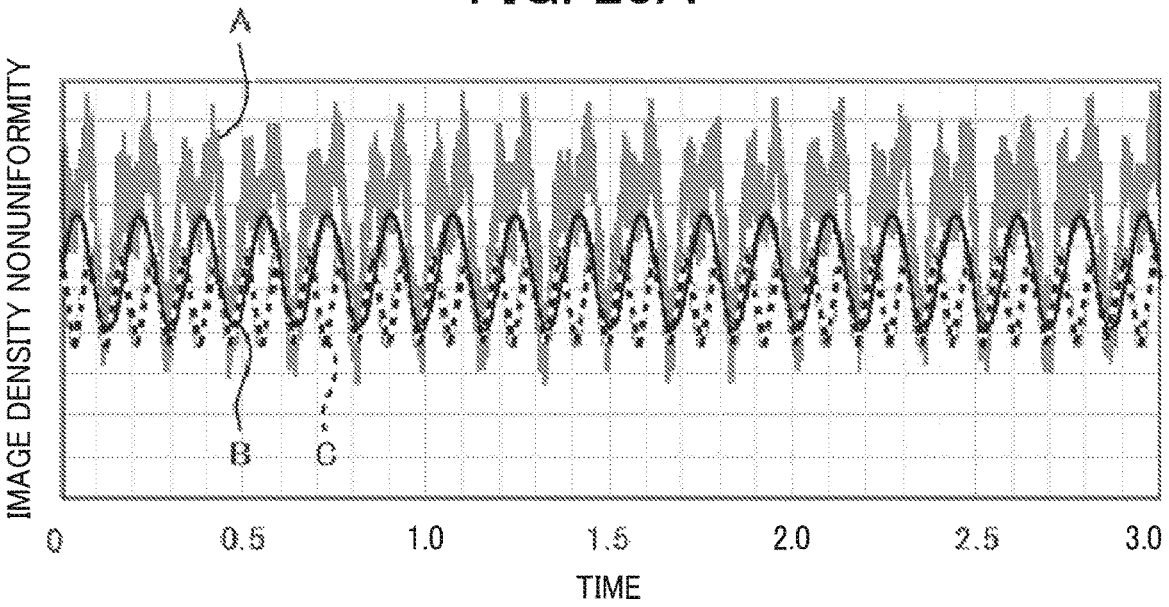
FIGS. 23A and 23B are graphs illustrating correction of density with the relation of the number of rotations of the screw joint and the number of rotations of the developing sleeve of FIG. 10.
Figure 23B:
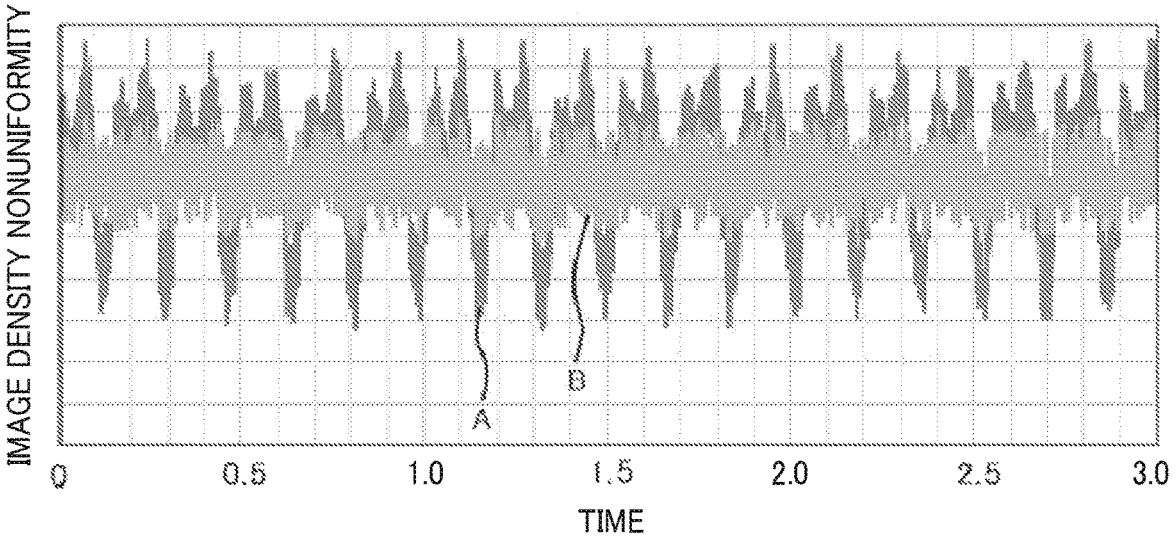

FIGS. 22A and 22B are graphs illustrating image density correction with a relation of the number of rotations of the screw joint 99 and the number of rotations of the developing sleeve 21*a* of FIG. 9. FIGS. 23A and 23B are graphs illustrating image density correction with a relation of the number of rotations of the screw joint 99 and the number of rotations of the developing sleeve 21*a* of FIG. 10.

In the graphs of FIGS. 22A, 22B, 23A, and 23B, descriptions are given with waveforms in which the component of the rotation period of the screw joint 99 and the component of the rotation period of the developing sleeve 21*a* have dominant image density nonuniformity. However, the actual image density nonuniformity is formed by an associated wave including more waveforms. For example, in addition to the above-described components, the periodic variation component generated at the rotation period of the photoconductor due to eccentricity of the photoconductor and distortion of the outer diameter of the photoconductor and the variation component generated at image transfer such as nonuniformity of rotation of the intermediate transfer belt are added to the actual image density nonuniformity.

As illustrated in FIGS. 22A and 22B, in a case in which the number of rotations of the screw joint 99 is not an integral multiple of the number of rotations of the developing sleeve 21*a*, the controller 300 can obtain, with the above-described frequency analysis, the (primary) component of the rotation period of the developing sleeve 21*a* illustrated as B in FIG. 22A. Accordingly, in this case, the (primary) component of the rotation period of the developing sleeve 21*a* is corrected, and therefore the image density nonuniformity cannot be restrained sufficiently, as illustrated in the waveform B in FIG. 22B.

Further, in order to correct the variation component at the rotation period of the screw joint 99, the pattern data of the rotation period of the screw joint 99 is created in addition to the variation pattern data at the rotation period of the developing sleeve (the development variation pattern data, the charging variation pattern data, and the latent image variation pattern data) and the variation pattern data of the rotation period of the photoconductor 3. As a result, the construction processing of the variation pattern data takes long.

Further, respective rotation sensors are to be provided in order to individually detect that the developer supply screws 24*a* of the developing devices 4Y, 4M, 4C, and 4K are brought to the respective rotation attitudes. Accordingly, the number of parts of the image forming apparatus 1000 increases, which leads to an increase in total cost of the image forming apparatus 1000.

In a case in which the frequency of the variation component of the rotation period of the developing sleeve 21*a* is close to the frequency of the variation component of the rotation period of the screw joint 99, the following inconvenience occur. That is, in the correction waveforms for canceling the variation component of the rotation period of the developing sleeve 21*a*, the waveform that is amplified by the waveform of the rotation period of the screw joint 99 becomes short, and therefore the waveform to be overcorrected becomes short. As a result, it is likely that the correction makes the image density nonuniformity worse. Specifically, in a case in which the variation component of the rotation period of the screw joint 99 is close to the high frequency that is two times or greater than the number of rotations of the developing joint 95, if the variation component is corrected so as to cancel the variation component of this high frequency, it is likely that the image density nonuniformity becomes remarkably worse.

By contrast, in a case in which the number of rotations of the screw joint 99 is two times as the number of rotations of the developing joint 95, the variation component (the primary component) of the rotation period of the developing sleeve as indicated with the waveform B in FIG. 23A and the variation component (the secondary component) that is two times as the number of rotations of the developing sleeve as indicated with a waveform C in FIG. 23A can be obtained with the above-described frequency analysis. Accordingly, in this case, the variation component of the rotation period of the developing sleeve and the variation component of the rotation period of the screw joint can corrected, and therefore the image density nonuniformity can be restrained reliably, as illustrated in the waveform B in FIG. 23B.

Further, by correcting higher order variation components of the rotation period of the developing sleeve, the variation component of the rotation period of the developer supply screw can also be corrected. Consequently, the variation pattern data of the rotation period of the screw joint (the developer supply screw) is not created, and therefore the construction processing of the variation patter data can be restrained from taking long. Further, the developing devices 4Y, 4M, 4C, and 4K can do without respective rotation sensors to individually detect that the respective screw joints (the developer supply screws) are brought to the predetermined rotation attitudes. Accordingly, an increase in cost of the image forming apparatus 1000 can be prevented.

Figure 24:
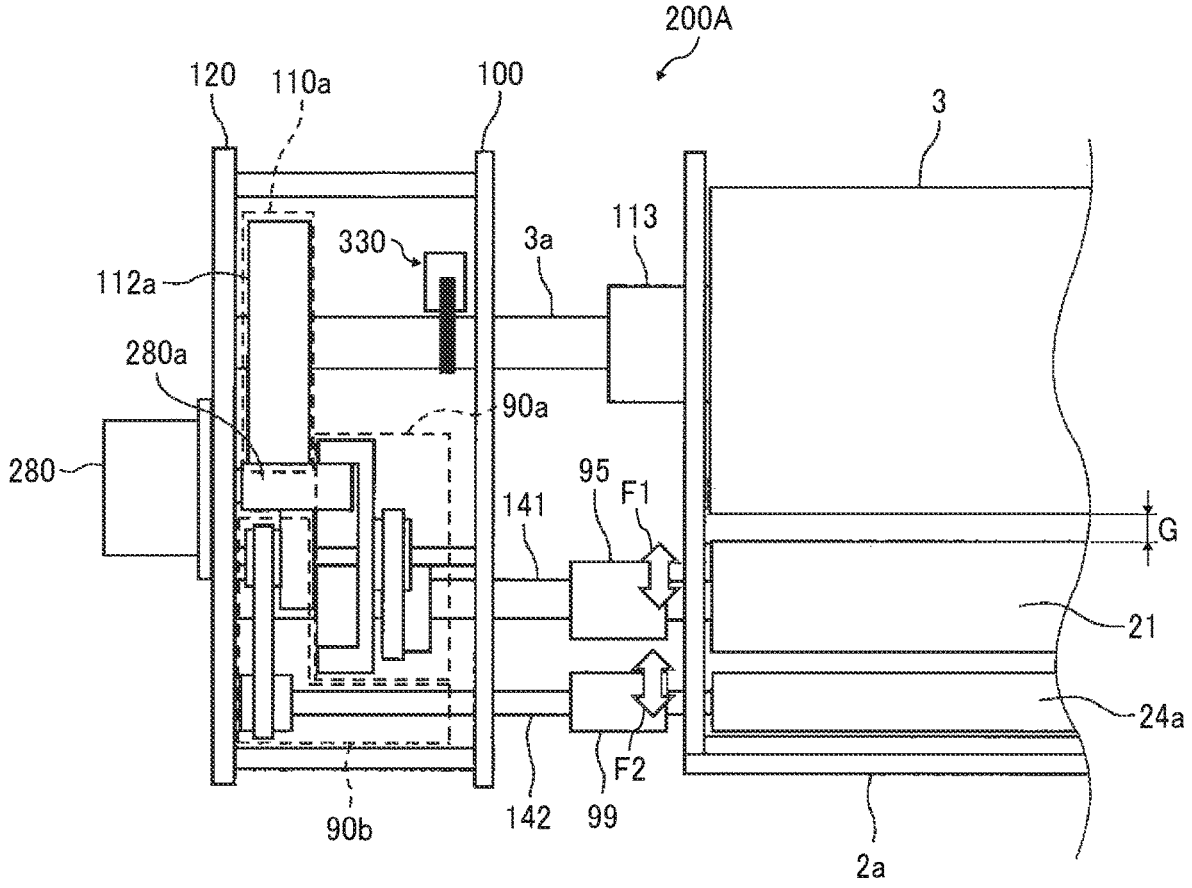
FIG. 24 is a schematic view illustrating a drive device according to a variation.

FIG. 24 is a schematic view illustrating a drive device 200A according to a variation of the present embodiment of this disclosure.

The drive device 200A according to this variation includes a single drive motor 280 that drives the photoconductors 3Y, 3M, 3C, and 3K and the rotary bodies (i.e., the developing sleeve 21*a*, the developer supply screw 24*a*, the developer collect screw 25*a*, and the developer agitation screw 26*a*). The configuration of the sleeve drive transmission passage 90*a* that transmits a driving force of the drive motor to the developing sleeve 21*a* and the configuration of the screw drive transmission passage 90*b* that transmits a driving force to the developer supply screw 24*a* are identical to the configurations of the drive device 200 as illustrated in FIGS. 7 and 8, respectively. A photoconductor drive transmission passage 110*a* that transmits a driving force to the photoconductor 3Y, 3M, 3C, and 3K includes a large diameter gear 112*a* that meshes with a motor gear 280*a* of the drive motor 280. The large diameter gear 112*a* is fixed to the photoconductor shaft 3*a* so as to rotate together with the photoconductor shaft 3*a* as a single unit.

In the drive device 200A of this variation, the drive transmission ratio of the developing sleeve drive transmission passage and the drive transmission ratio of the screw drive transmission passage are respectively set to be integral multiples of the drive transmission ratio of the photoconductor drive transmission passage. Accordingly, in addition to the long period gap variation caused by the gap variation of the rotation period of the screw joint, the long period gap variation caused by the gap variation of the rotation period of the photoconductor can be restrained. Consequently, different image density nonuniformity depending pages can be restrained more reliably.

Further, in a case in which the periodic image density nonuniformity is corrected, the variation component of higher order image density nonuniformity of the number of rotations of the photoconductor is also corrected. By so doing, the variation component of the rotation period of the developing sleeve and the variation component of the rotation period of the developer supply screw can also be corrected. Consequently, the construction processing of the variation pattern data can be prevented from taking long.

Further, in a case in which a drive motor is provided to drive the photoconductor and another drive motor is provided to drive the developing sleeve and the developer supply screw, it is difficult to completely match respective drive start timings of the motors. As a result, as a long term use of the image forming apparatus 1000, the phase of the variation component of the rotation period of the photoconductor shifts from the phase of the variation component of the rotation period of the developing sleeve or the developer supply screw.

However, since the photoconductor, the developing sleeve, and the developer supply screw are driven by a single motor, the phase of the variation component of the rotation period of the photoconductor and the shift of the variation component of the rotation period of the developing sleeve or the developer supply screw do not shift from each other. Accordingly, the image forming apparatus 1000 can do without respective rotation sensors to individually detect that the developing sleeve 21*a* of the developing devices 4Y, 4M, 4C, and 4K are brought to the respective rotation attitudes. Accordingly, the total cost of the image forming apparatus 1000 can be reduced.

It is to be noted that the photoconductor rotation sensor may be replaced with a sleeve rotation sensor. Alternatively, a rotation sensor may be provided to detect that the developer supply screws are brought to the predetermined rotation attitudes. By so doing, the state in which the photoconductor rotation sensors and the developing sleeve are brought to the predetermined rotation attitudes can be detected based on the detection results of the rotation sensor.

The configurations according to the above-descried embodiments are not limited thereto. This disclosure can achieve the following aspects effectively.

Aspect 1.

An image forming apparatus (for example, the image forming apparatus 1000) includes an image bearer (for example, the photoconductor 3), a developing device (for example, the developing device 4), a drive source (for example, the developing motor 91), a first joint (for example, the developing joint 95), a rotary body (for example, the developer supply screw 24*a*, the photoconductor 3), a second joint (for example, the screw joint 99), and a drive device (for example, the drive device 200) including a first drive transmission passage (for example, the sleeve drive transmission passage 90*a*) and a second drive transmission passage (for example, the screw drive transmission passage 90*b*). The image bearer is configured to form a latent image on a surface thereof. The developing device is configured to develop the latent image formed on the image bearer to a visible image. The developing device includes a developer bearer (for example, the developing roller 21) configured to bear a developer on a surface thereof. The drive source is configured to apply a driving force. The first drive transmission passage is a passage through which the driving force of the drive source is transmitted to the developer bearer via the first joint. The second drive transmission passage is a passage through which the driving force of the drive source is transmitted to the rotary body via the second joint. The first drive transmission passage and the second drive transmission passage are defined such that one of a first drive transmission ratio from the drive source to the first joint of the first drive transmission passage and a second drive transmission ratio from the drive source to the second joint of the second drive transmission passage being an integral multiple of the other of the first drive transmission ratio from the drive source to the first joint of the first drive transmission passage and the second drive transmission ratio from the drive source to the second joint of the second drive transmission passage.

In a comparative image forming apparatus, the image density nonuniformity (how the image density varies and the amplitudes of the image density variation) become different from each other depending on pages due to the following reasons. A development gap is formed between the image bearer and the developer bearer. Due variations of the development gap, a development electric field generated between the developer bearer and the image bearer varies, and therefore the image density varies due to the variation of the development electric field. One of the reasons that cause variations of the development gap is distortion of the outer diameter of the developer bearer. If the developer bearer has distortion on the outer diameter, the development gap varies at the rotation period of the developer bearer. Other than the distortion of the outer diameter of the developer bearer, the shaft reaction force of a shaft according to the rotation period of the second joint generated at the second joint also causes variations of the developer gap. The shaft reaction force of the shaft is caused due to deviation (axis misalignment) between the center of the rotary shaft of the rotary body and the center of the rotary shaft of a drive output body that outputs the driving force to the rotary body via the second joint that is coaxially mounted with the rotary body.

If the shaft reaction force of the shaft according to the rotation period of the second joint is generated to the second joint, the developing drive casing that rotatably supports the developer bearer that is fitted to a bearing that receives the shaft is pressed toward the image bearer via the shaft of the rotary body. As a result, the development gap between the developer bearer and the image bearer varies at the rotation period of the second joint. When the rotation period of the second joint is not an integral multiple of the rotation period of the developer bearer, a short period variation component and a long period variation component having a period of one page of more as gap variation components of the development gap, as illustrated in FIG. 9. Due to variations of the long period development gap, a long period image density nonuniformity is generated. Due to the long period image density nonuniformity, the image density nonuniformity become different depending on pages.

In Aspect 1, one of a first drive transmission ratio from the drive source to the first joint of the first drive transmission passage and a second drive transmission ratio from the drive source to the second joint of the second drive transmission passage is an integral multiple of the other of the first drive transmission ratio from the drive source to the first joint of the first drive transmission passage and the second drive transmission ratio from the drive source to the second joint of the second drive transmission passage. Accordingly, as illustrated in FIG. 10, the long period variation component is eliminated from the variation component of the development gap. As a result, the long period image density nonuniformity that extends more than one page caused due to the long period development gap variation can be restrained, and therefore the image density nonuniformity different between pages can also be restrained.

Aspect 2.

In Aspect 1, the rotary body is a developer supplying body (for example, the developer supply screw 24*a*) configured to supply the developer in the developing device (for example, the developing device 4) to the developer bearer (for example, the developing roller 21).

According to this configuration, as described in the embodiments above, the long period gap variation of the development gap (for example, the development gap G) due to the shaft reaction force of the shaft of the developer supplying body and the shaft of the second joint (for example, the screw joint 99) drivingly coupled to the developer supplying body can be restrained. Therefore, the image density nonuniformity depending on pages can also be restrained.

Aspect 3.

In Aspect 1, the rotary body is the image bearer (for example, the photoconductor 3).

According to this configuration, as described in reference to FIG. 24, the long period gap variation of the development gap (for example, the development gap G) due to eccentricity of the rotary shaft of the image bearer can be restrained. Therefore, the image density nonuniformity depending on pages can also be restrained.

Aspect 4.

In any one of Aspect 1 through Aspect 3, the number of rotation of the drive source (for example, the developing motor 91) is an integral multiple of the number of rotation of the developer bearer (for example, the developing sleeve 21*a*).

According to this configuration, as described in the embodiments above, the long period variation component in the gap variation of the development gap (for example, the development gap G) due to vibration of the drive source can be restrained. Therefore, the image density nonuniformity depending on pages can also be restrained.

Aspect 5.

In any one of Aspect 1 through Aspect 4, the image forming apparatus (for example, the image forming apparatus 1000) includes a charging device (for example, the charging device 5 and the charging power supply 302), a latent image writing device (for example, the optical writing devices 1YM and 1CK), a rotation attitude detector (for example, the sleeve rotation sensor 310), and a periodic vibration device (for example, the controller 300). The charging device is configured to charge the surface of the image bearer (for example, the photoconductor 3). The latent image writing device is configured to optically write the latent image to the surface of the image bearer charged by the charging device. The rotation attitude detector is configured to detect a rotation attitude of the developer bearer (for example, the developing roller 21). The periodic variation device is configured to vary, based on detection result of the rotation attitude detector, at least one of a charging intensity generated by the charging device, a developing bias to be applied to the developer bearer, and a latent image writing intensity generated by the latent image writing device at a rotation period of the developing bearer.

According to this configuration, as described in the above-described embodiments, the image density nonuniformity at the rotation period of the developer bearer can be restrained.

Aspect 6.

In Aspect 5, the periodic variation device (for example, the controller 300) varies at least one of the charging intensity, the developing bias, and the latent image writing intensity with a variation pattern of one period of the developer bearer (for example, the developing roller 21) and varies at least one of the charging intensity, the developing bias, and the latent image writing intensity with a variation pattern of a period of an integral multiple of the developer bearer.

Consequently, the image density nonuniformity having the period of one period of the developer bearer can be restrained and the image density nonuniformity having the period of an integral multiple of the developer bearer can also be restrained.

Further, as described in Aspect 1, the image density nonuniformity due to the shaft reaction force of the shaft according to the rotation period of the second joint (for example, the screw joint 99) can be restrained by using the variation pattern of the period of an integral multiple of the developer bearer.

Aspect 7.

In Aspect 5 or Aspect 6, the periodic variation device (for example, the controller 300) varies at least one of the charging intensity, the developing bias, and the latent image writing intensity with a superimposed variation pattern superimposed by a component to vary at the rotation period of the image bearer (for example, the photoconductor 3) and a component to vary at the rotation period of the developer bearer (for example, the developing roller 21).

According to this configuration, the image density nonuniformity at the rotation period of the image bearer due to eccentricity of the image bearer can be restrained.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. An image forming apparatus comprising:

a drive source configured to generate a driving force;

a first rotary body supported by a support member and configured to receive the driving force applied by the drive source and transmitted via a first joint having a first detachable engaging member and a first detachable engaged member;

a second rotary body supported by the support member sharing with the first rotary body and configured to receive the driving force applied by the drive source and transmitted via a second joint having a second detachable engaging member and a second detachable engaged member, wherein a ratio of a number of rotations of the first joint and a number of rotations of the second joint being an integer thereof;

a charging device configured to charge a surface of an image bearer;

a latent image writing device configured to optically write a latent image to the surface of the image bearer charged by the charging device;

a rotation attitude detector configured to detect a rotation attitude of the first rotary body; and a periodic variation device configured to vary, based on detection result of the rotation attitude detector, at least one of a charging intensity generated by the charging device, a developing bias to be applied to the first rotary body, and a latent image writing intensity generated by the latent image writing device at a rotation period of the first rotary body.

2. The image forming apparatus according to claim 1, wherein a number of rotations of the drive source is an integer multiple of a number of rotations of the first rotary body.

3. The image forming apparatus according to claim 1, wherein the periodic variation device varies at least one of the charging intensity, the developing bias, and the latent image writing intensity with a variation pattern of one period of the first rotary body and varies at least one of the charging intensity, the developing bias, and the latent image writing intensity with a variation pattern of a period of an integral multiple of the first rotary body.

4. The image forming apparatus according to claim 1, wherein the periodic variation device varies at least one of the charging intensity, the developing bias, and the latent image writing intensity with a superimposed variation pattern superimposed by a component to vary at a rotation period of the image bearer and a component to vary at the rotation period of the first rotary body.

5. The image forming apparatus according to claim 1, wherein the first rotary body includes a developer bearer.

6. The image forming apparatus according to claim 1, wherein the second rotary body includes a developer agitator configured to agitate the developer.

7. The image forming apparatus according to claim 1, wherein the second rotary body includes a developer collector configured to collect the developer.

8. The image forming apparatus according to claim 1, wherein the second rotary body includes an image bearer.

9. The image forming apparatus according to claim 1, wherein the ratio of the number of rotations of the first joint and the number of rotations of the second joint is the integer which is equal to or greater than two.

10. An image forming apparatus comprising:

a drive source configured to generate a driving force;

a first rotary body supported by a support member and configured to receive the driving force applied by the drive source and transmitted via a first joint having a first detachable engaging member and a first detachable engaged member; and a second rotary body supported by the support member sharing with the first rotary body and configured to receive the driving force applied by the drive source and transmitted via a second joint having a second detachable engaging member and a second detachable engaged member, wherein a ratio of a number of rotations of the first joint and a number of rotations of the second joint is an integer equal to or greater than two, and wherein the second rotary body includes a developer agitator configured to agitate the developer.

11. An image forming apparatus comprising:

a drive source configured to generate a driving force;

a first rotary body supported by a support member and configured to receive the driving force applied by the drive source and transmitted via a first joint having a first detachable engaging member and a first detachable engaged member; and a second rotary body supported by the support member sharing with the first rotary body and configured to receive the driving force applied by the drive source and transmitted via a second joint having a second detachable engaging member and a second detachable engaged member, wherein a ratio of a number of rotations of the first joint and a number of rotations of the second joint is an integer equal to or greater than two, and wherein the second rotary body includes a developer collector configured to collect the developer.

* * * * *